US007178978B2

(12) United States Patent
Argentine et al.

(10) Patent No.: US 7,178,978 B2
(45) Date of Patent: Feb. 20, 2007

(54) FLUID MIXING APPARATUS AND METHOD

(75) Inventors: Jeffery C. Argentine, Petaluma, CA (US); Ian Ayton, Santa Ynez, CA (US)

(73) Assignee: Boston Scientific Santa Rosa Corp.,, Santa Rosa, CA (US)

( * ) Notice: Subject to any disclaimer, the term of this patent is extended or adjusted under 35 U.S.C. 154(b) by 77 days.

(21) Appl. No.: 10/658,074

(22) Filed: Sep. 8, 2003

(65) Prior Publication Data

US 2005/0052946 A1 Mar. 10, 2005

(51) Int. Cl.
*B01F 5/06* (2006.01)
*B01F 5/12* (2006.01)

(52) U.S. Cl. ..... 366/268; 366/269

(58) Field of Classification Search ..... 366/268, 366/269, 177.1, 176.3, 181.1, 190
See application file for complete search history.

(56) References Cited

U.S. PATENT DOCUMENTS

| | | | | | |
|---|---|---|---|---|---|
| 49,345 | A | * | 8/1865 | Hervey | 366/268 |
| 126,735 | A | * | 5/1872 | Moxley | 366/268 |
| 127,290 | A | * | 5/1872 | Anderson | 366/268 |
| 314,163 | A | * | 3/1885 | Blakemore et al. | 366/268 |
| 338,538 | A | * | 3/1886 | Marchand | 426/530 |
| 357,027 | A | * | 2/1887 | Ping | 366/268 |
| 492,945 | A | * | 3/1893 | Phegley | 366/268 |
| 756,953 | A | * | 4/1904 | Gaulin | 366/176.3 |
| 950,069 | A | * | 2/1910 | Farrar | 366/268 |
| 1,264,071 | A | * | 4/1918 | Hensrud | 366/268 |
| 1,288,966 | A | * | 12/1918 | Nielsen | 417/265 |
| 1,550,882 | A | * | 8/1925 | Colony | 366/268 |
| 1,685,424 | A | * | 9/1928 | Hurrell | 366/176.3 |
| 1,694,589 | A | * | 12/1928 | Fish | 366/176.3 |
| 1,898,894 | A | * | 2/1933 | Richards et al. | 366/176.3 |
| 1,930,686 | A | * | 10/1933 | MacChesney | 366/176.3 |
| 1,956,082 | A | * | 4/1934 | Schwimmer | 366/176.3 |
| 2,030,251 | A | * | 2/1936 | Greener | 366/176.3 |
| 2,056,931 | A | * | 10/1936 | Bannister | 366/176.3 |
| 3,035,820 | A | * | 5/1962 | Todd et al. | 366/268 |
| 3,353,918 | A | * | 11/1967 | Perrin | 422/133 |
| 4,040,420 | A | | 8/1977 | Speer | |
| 4,273,261 | A | | 6/1981 | Krueger | |
| 4,350,650 | A | * | 9/1982 | Cereghini | 366/268 |
| 4,391,389 | A | | 7/1983 | Catalfamo | |
| 4,621,667 | A | | 11/1986 | Eberle | |
| 4,693,397 | A | | 9/1987 | Lang | |
| 4,845,025 | A | | 7/1989 | Lary et al. | |
| 4,876,038 | A | * | 10/1989 | Wigglesworth et al. | 366/268 |
| 4,915,881 | A | * | 4/1990 | Straw et al. | 366/258 |
| 4,965,509 | A | | 10/1990 | Oldham | |
| 5,104,375 | A | | 4/1992 | Wolf et al. | |

(Continued)

FOREIGN PATENT DOCUMENTS

| | | | |
|---|---|---|---|
| GB | 2 035 261 | A | 6/1980 |

(Continued)

*Primary Examiner*—Tony G. Soohoo
(74) *Attorney, Agent, or Firm*—Hoffmann & Baron LLP

(57) ABSTRACT

This invention relates to devices, methods, and systems for mixing materials, and in particular provides linkages and containers such as syringes in operative arrangement such that actuation of the linkages can move material from one container to another thereby mixing the material. This invention may be used in a wide variety of applications, including industrial, domestic, and medical.

24 Claims, 22 Drawing Sheets

U.S. PATENT DOCUMENTS 5,226,877 A 7/1993 Epstein
5,261,884 A 11/1993 Stern et al.
5,445,614 A 8/1995 Haber et al.
5,464,396 A 11/1995 Barta et al.
5,540,498 A * 7/1996 Chu ..... 366/181.8
5,542,578 A 8/1996 Buckles
5,584,815 A 12/1996 Pawelka et al.
5,648,265 A 7/1997 Epstein
5,665,067 A 9/1997 Linder et al.
5,810,773 A 9/1998 Pesnicak
5,823,671 A * 10/1998 Mitchell et al. ..... 366/268
6,047,861 A 4/2000 Vidal et al.
6,062,722 A * 5/2000 Lake ..... 366/268
6,197,194 B1 3/2001 Whitmore
6,233,936 B1 5/2001 Jeanbourquin
6,242,267 B1 6/2001 Herron et al.
6,474,369 B2 11/2002 Castellano
6,592,251 B2 * 7/2003 Edwards et al. ..... 366/268
2001/0016703 A1 8/2001 Wironen et al.
2002/0077589 A1 6/2002 Tessari
2002/0101785 A1 8/2002 Edwards et al.
2003/0018357 A1 1/2003 Luthra et al.
2003/0027203 A1 2/2003 Fields

FOREIGN PATENT DOCUMENTS

JP 06 100054 A 4/1994
WO WO 03/013630 A2 2/2003

* cited by examiner

FLUID MIXING APPARATUS AND METHOD

BACKGROUND OF THE INVENTION

This invention relates to devices, methods, and systems for mixing materials, and in particular provides linkages and containers such as syringes in operative arrangement such that actuation of the linkages can move material from one container to another thereby mixing the material. This invention may be used in a wide variety of applications, including industrial, domestic, and medical.

A linkage can be defined as a system of links or bars, connected together by joints. A linkage bar can be represented by a rigid straight line, defining a constant distance between two joints. A joint can be a connection between two or more bars, allowing some motion between the connected bars. The purpose for many linkages is to transmit force or motion. For example, linkages can convert linear motion to rotary motion, and vice versa. Throughout this specification, terminology such as that described above for linkages is provided for illustrative rather than exhaustive purposes. Accordingly, the present invention is not meant to be limited by such descriptions.

Traditionally, mixing devices and methods such as those employing syringes have required the operator to directly actuate the syringe by pressing on a syringe plunger. Other mixing systems involve syringe actuation by primarily horizontal forces. These approaches are often unstable, however, and not well suited for precise and accurate mixing that may be required, for example, in a surgical operating environment where clinical efficiency is paramount. Further, these systems frequently fail to provide for mixing sequences involving multiple steps, such as when more than two materials are mixed together, or when more than two materials are mixed together in a particular sequence.

It would be desirable to have improved methods and systems that provide for stable, secure, and balanced mixing, with greater ease of use for the operator. It would also be desirable to have improved methods and systems that facilitate simple and convenient mixing of more than two materials in a particular sequence.

BRIEF SUMMARY OF THE INVENTION

In one aspect, the present invention provides a device for mixing a material. The device can include a base, and a first linkage and second linkage each coupled with the base. The first linkage may have at least two bars coupled together via at least one joint, the first linkage configured to contact a first plunger of a first syringe to move a material from a first container through a conduit to a second container. Similarly, the second linkage may have at least two bars coupled together via at least one joint, the second linkage configured to contact a second plunger of the second container to move the material from the second container through the manifold to the first container. In a related aspect, the device may be configured to mix the material by movement of the material between the first and second containers via the conduit. Further, the device can be configured to mix a first material contained in the first container with a second material contained in the second container by movement of the first and second materials between the first and second containers via the conduit. The two bars and joint of the first linkage can have a first rocker bar pivotally coupled with a first coupler bar via a first rocker-coupler joint. The first rocker bar can be pivotally coupled with the base, and a first end of the first coupler bar can be in translational cooperation with the base. Similarly, the two bars and joint of the second linkage can have a second rocker bar pivotally coupled with a second coupler bar via a second rocker-coupler joint, and the second rocker bar can be pivotally coupled with the base, and a first end of the second coupler bar can be in translational cooperation with the base.

In a device according to the present invention, the first linkage can have a first linkage geometry such that activation of the first linkage is accomplished by a force applied at a handle end of the first rocker bar, the force having a primary vector substantially orthogonal to a resting plane of the base. The first linkage geometry may ensure that the primary vector is sufficient to maintain the position of the base on a resting surface during operation of the device. Similarly, the second linkage can have a second linkage geometry such that activation of the second linkage is accomplished by a force applied at a handle end of the second rocker bar, the force having a primary vector substantially orthogonal to a resting plane of the base. The second linkage geometry may ensure that the primary vector is sufficient to maintain the position of the base on a resting surface during operation of the device.

The present invention also provides a device having a conduit that includes a tube. Relatedly, the conduit can include a manifold. At least one of the first and second containers can include a syringe. A device according to the present invention can also include a base that has a plurality of feet. Each base foot can have a compressible point, and the compressible point can include an elastomer.

In another aspect, the present invention provides a device for mixing a material, the device including a base, and a first linkage and second linkage each coupled with the base. The first linkage may be configured to move a first material from a first container to a second chamber via a conduit, and the second linkage can be configured to move the material from the second container via the conduit to the first container. The device may be configured to mix the first material contained in the first container with a second material contained in the second container, wherein the movement of the first and second materials between the first and second containers contributes to the mixing of the first and second materials. What is more, the first container can include a first syringe and the second container can include a second syringe. The first linkage may be configured to drive a first plunger of the first syringe and the second linkage may be configured to drive a second plunger of the second syringe. In some aspects, the first linkage can have a first rocker bar pivotally coupled with a first coupler bar via a first rocker-coupler joint. The first rocker bar can be pivotally coupled with the base, and a first end of the first coupler bar can be in translational cooperation with the base. Similarly, the second linkage can have a second rocker bar pivotally coupled with a second coupler bar via a second rocker-coupler joint. The second rocker bar can be pivotally coupled with the base, and a first end of the second coupler bar can be in translational cooperation with the base.

In a device according to the present invention, the first linkage can include a first linkage geometry such that activation of the first linkage is accomplished by a force applied at a handle end of the first rocker bar, the force having a primary vector substantially orthogonal to a resting plane of the base. The first linkage geometry may ensure that the primary vector is sufficient to maintain the position of the base on a resting surface during operation of the device. Similarly, the second linkage can have a second linkage geometry such that activation of the second linkage is accomplished by a force applied at a handle end of the second rocker bar, the force having a primary vector substantially orthogonal to a resting plane of the base. The second linkage geometry may ensure that the primary vector is sufficient to maintain the position of the base on a resting surface during operation of the device.

In another aspect, the present invention provides a method for mixing a first material with a second material. The method can include activating a first linkage to move at least a portion of a first material from a first chamber to a second chamber, the second chamber containing a second material, and activating a second linkage to move at least a portion of the first material and the second material from the second chamber to the first chamber. The movement of at least a portion of the first material and at least a portion of the second material between the first chamber and the second chamber may result in the mixing of at least a portion of the two materials. In some aspects, activation of the first linkage can cause translation of a first end of a first coupler bar, the translation resulting in movement of the first material from the first container to the second chamber. Relatedly, activation of the second linkage can cause translation of a first end of a second coupler, the translation resulting in movement of the first material and the second material from the second chamber to the first chamber. The first syringe can include a first plunger and the first chamber. The second syringe can include a second plunger and the second chamber. Activation of the first linkage may impel a first end of a first coupler bar to actuate the first plunger, and the actuation of the first plunger may result in movement of at least a portion of the first material from the first chamber to the second chamber. Activation of the second linkage can impel a first end of a second coupler bar to actuate the second plunger, and the actuation of the second plunger can result in movement of at least a portion of the first material and at least a portion of the second material from the second chamber to the first chamber. Further, actuation of the first plunger can drive the first plunger towards a passage of the first syringe, and actuation of the second linkage can drive a second plunger towards a passage of the second syringe.

In yet another aspect, the present invention provide a method of restraining a mixing device on a surface. The method can include coupling a base of the device with a plurality of feet, each foot having a conical point configured to contact the surface. Relatedly, the feet can have points that are of any of a variety of shapes. The conical points can include a deformable elastomer. Further, the conical points can be compressible or retractable. Each foot can include a ring or area that at least partially encircles the conical point such that the ring contacts the surface when the conical point compresses.

In another aspect, the present invention provides a device for mixing a material, the device including a base, and a first linkage and second linkage each coupled to the base. The first linkage can include at least two bars coupled together via at least one joint, and the first linkage may be configured to contact a first plunger of a first syringe to move a material from a first syringe through a conduit to a second syringe. Similarly, the second linkage can include at least two bars coupled together via at least one joint, and the second linkage may be configured to contact a second plunger of the second syringe to move the material from the second syringe through the conduit to the first syringe. The movement of the material between the first and second syringes can contribute to the mixing of the material. The device can include a plurality of feet coupled with the base. Each foot can include a compressible point and a contact patch, and the compressible point and the contact patch may be adapted to contact a surface and inhibit movement of the device on the surface.

In another aspect, the present invention provides system for mixing a first material with a second material. The system can include a first linkage having at least two bars and at least one joint, a second linkage having at least two bars and at least one joint, a first syringe containing a first material, a second syringe containing a second material, and a base coupled with the first linkage and the second linkage. The first linkage may be configured to contact a first plunger of the first syringe to move the first material through a conduit to a second syringe. The second linkage may be configured to contact a second plunger of the second syringe to move the first material and the second material through the conduit to the first syringe. The movement of the first and second materials between the first and second syringes can contribute to the mixing of the materials.

In still another aspect, the present invention provides a kit that includes a mixer, wherein the mixer can include a base and a first linkage and second linkage each coupled with the base. The first linkage can include at least two bars coupled together via at least one joint, and the first linkage may be configured to contact a first activator of a first container to move a material from a first container through a conduit to a second container. Similarly, the second linkage can include at least two bars coupled together via at least one joint, and the second linkage may be configured to contact a second activator of the second container to move the material from the second container through the conduit to the first container. The kit may also include instructions to use the mixer for mixing at least one material.

In a further aspect, a base according to the present invention may include a plurality of feet. Further, each foot may have a compressible point, and each compressible point can include an elastomer. Relatedly, each compressible point can include a conical tip. What is more, each foot may have a contact patch. The contact patch can include a ring or other shape that encircles at least partially or is adjacent to the conical point.

In another aspect, the present invention provides a support that inhibits movement of an object on a surface. The support may have a compressible point adapted to contact the surface and inhibit movement of the object on the surface, and a contact patch adapted to contact the surface and to further inhibit movement of the object on the surface. Relatedly, the compressible point may include an elastomer. What is more, the contact patch may be adapted to contact the surface as the compressible point compresses. The compressible point may compress due to the weight of the device or the actuation forces applied to the device, or both. Further, the contact patch can be a ring that encircles the compressible point.

For a fuller understanding of the nature and advantages of the present invention, reference should be had to the ensuing detailed description taken in conjunction with the accompanying drawings. The drawings represent embodiments of the present invention simply by way of illustration. The invention is capable of modification in various respects without departing from the invention. Accordingly, the drawings and description of these embodiments are illustrative in nature, and not restrictive. For example, although the exemplary embodiments described herein are in the field of medical applications, the invention is not so limited and may be used when it is desirable to mix together any two or more materials in any desired proportion.

DETAILED DESCRIPTION OF THE INVENTION

Figure 1:
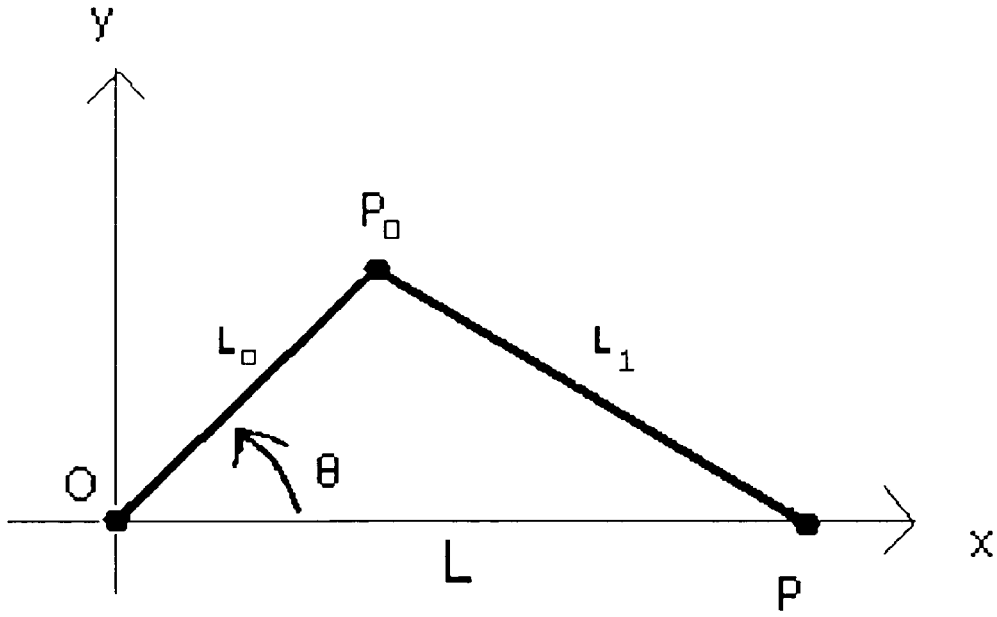
FIG. 1 shows a schematic representation of a linkage geometry according to an embodiment of the present invention.

Turning now to the drawings, FIG. 1 illustrates a skeleton outline of an exemplary 2-bar linkage, and includes geometrical information for determining the relative motion of the joints and links. A first bar, a rocker, corresponds to length $L_0$. The first bar can pivot with oscillatory rotation about fixed point O, which can be a rotating pin joint. Opposite of point O, the first bar is connected with a second bar at point $P_0$, which also can be a rotating pin joint. In this way, the first bar can be pivotally coupled with the second bar. The second bar, a connecting rod or coupler, corresponds to length $L_1$. Opposite of point $P_0$, the end of second bar corresponds to point P, which may be a translating slider joint. Length L corresponds to the distance between point O and point P, and angle θ corresponds with the angle between the rocker and the x-axis. Movement of point P can occur along the x-axis, such that length L varies with angle θ. The devices and methods of the present invention incorporate many of the principles provided in FIG. 1, in which an oscillatory input motion of the first bar can result in a lateral translation output motion of point P.

Figure 2A:
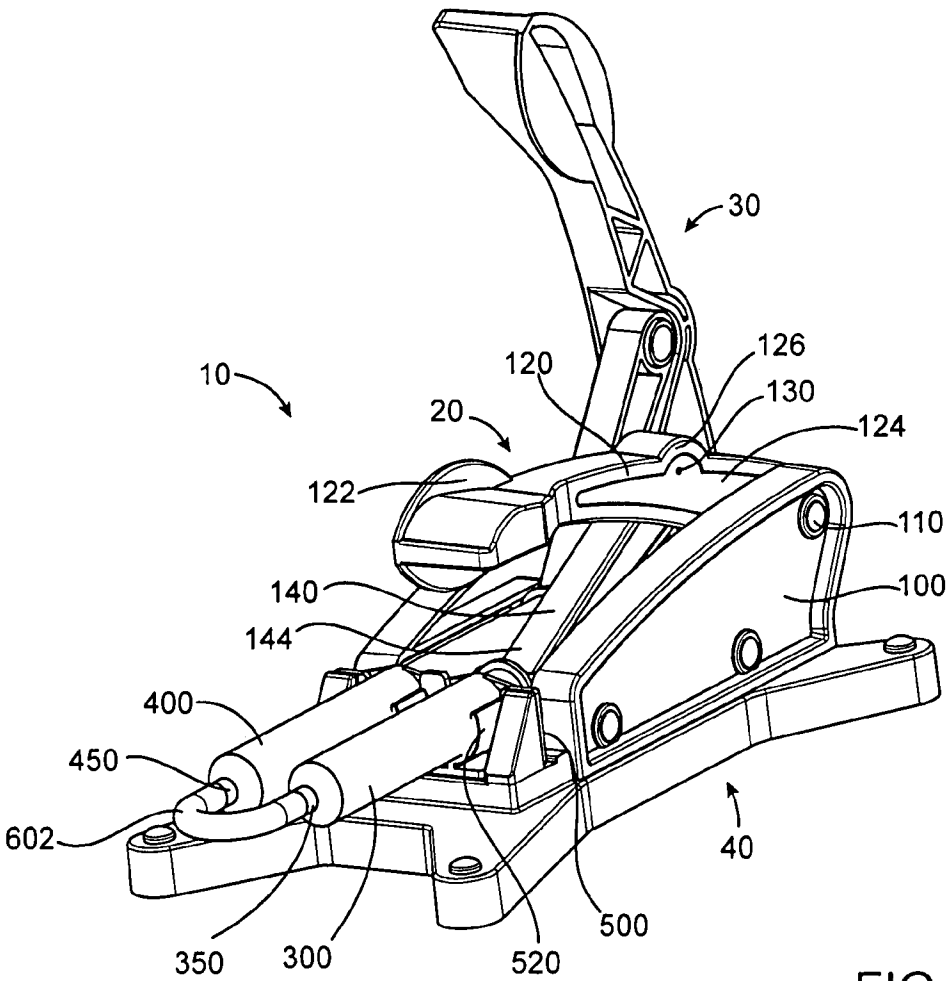
FIG. 2A shows perspective view of a mixing device according to an embodiment of the present invention.
Figure 2B:
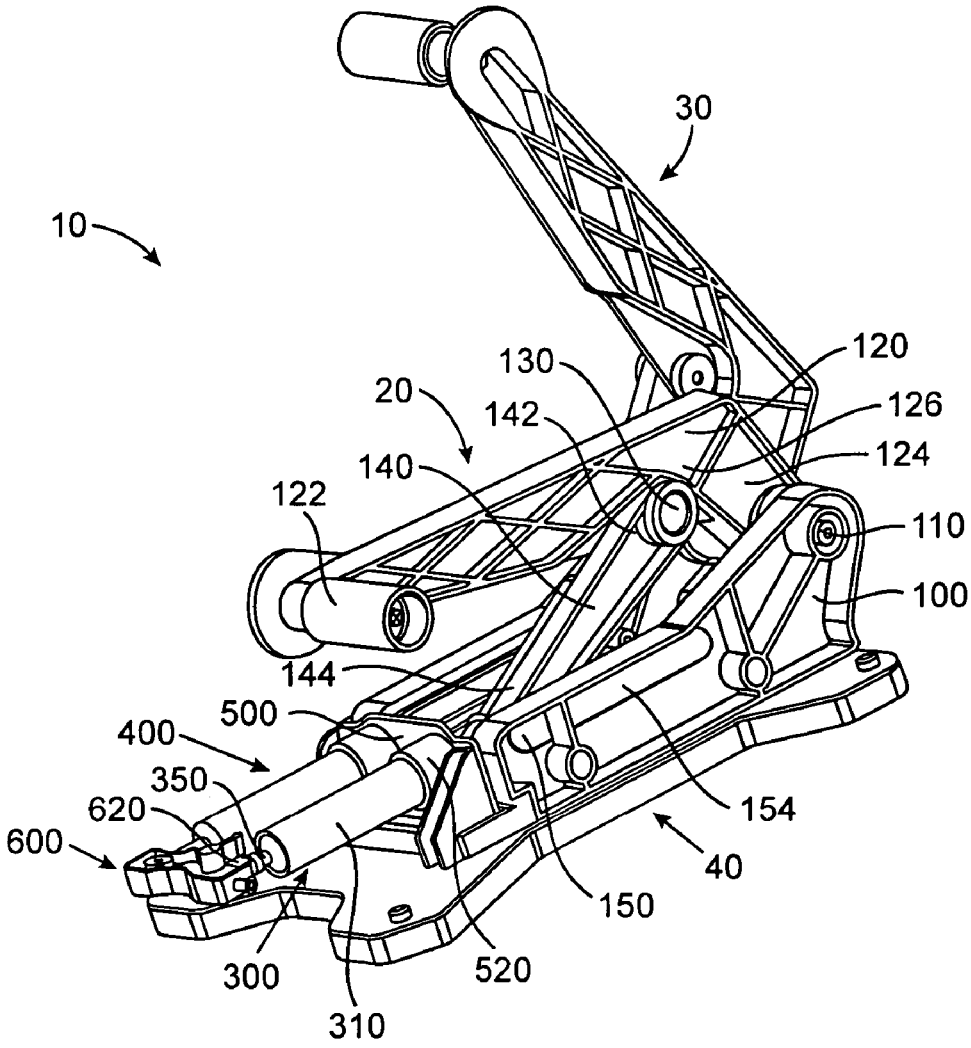
FIG. 2B shows a perspective view of a mixing device according to an embodiment of the present invention.

FIGS. 2A and 2B show a mixing device 10 according to the present invention. Mixing device 10 includes a first linkage 20 and second linkage 30, both attached with a base 40. A first housing 100 can be connected with a shoulder 124 of a first rocker 120 via a first housing-rocker joint 110. First housing 100 can also be connected with base 40. An elbow 126 of first rocker 120 may be pivotally connected or coupled to a second end 142 of a first coupler 140 via a first rocker-coupler joint 130. A first end 144 of first coupler 140 can be in translational cooperation with base 40. For example, first end 144 of first coupler 140 can be slidably engaged with a housing guide 154 of housing 100 at a first coupler-housing joint 150. A first rocker handle 122 may comprise a paddle, as depicted in FIG. 2A. Optionally, rocker handle 122 can be rotatably coupled with first rocker 120, as shown in FIG. 2B. Second linkage 30 may be similarly arranged. The linkages and base may constructed to comprise any of a variety of materials, including polymers, metals, alloys, and composites. Linkages can comprise, for example, a polycarbonate filled with 7% glass and added Teflon. Polypropylene, nylon, and ABS are other examples, as are suitable metals or alloys, such as aluminum and its alloys or stainless steel, for example, for materials for the linkages and the base, in any desirable combination.

A first container, here in the form of a syringe 300, and a second container, here in the form of a syringe 400, can be in operative arrangement with first linkage 20 and second linkage 30, respectively. Although FIGS. 2A and 2B depict the use of syringes, the invention can be used with a wide variety of containers that hold materials provided the contents of the container may be transferred via a plunger, an activator, or another similar component as described herein. Similarly, the containers can be linked via an assortment of conduits or other connections. For example, as shown in FIG. 2A, a first passage 350 of first syringe 300 and a second passage 450 of second syringe 400 can be in fluid communication via a conduit such as a tube 602. By comparison, as shown in FIG. 2B, first syringe 300 can be connected with second syringe 400 via a manifold 600. First syringe 300 may include a first barrel 310 disposed within a first holder 520 of a syringe collar 500. First passage 350 of first syringe 300 can be in fluid connection with a first duct 620 of a manifold 600. Second syringe 400 may be similarly configured. The containers and conduits may be manufactured from a variety of materials, although it is desirable that the material used be compatible with the substances being mixed by the mixing device. Further, the dimension of the containers and conduits can vary widely, and will often depend on the characteristics of the materials to be mixed or other mixing conditions. In some cases, a conventional 30 ml capacity syringe may be used. The inner diameter of a tube may range, for example, from about 1/32" to about 5/32". In some instances, the inner diameter of a tube may be about 3/32". Likewise, the outer diameter of a tube may range from about 5/32" to about 9/32". In some instances, the outer diameter of a tube may be about 7/32". Tube dimensions such as those described here may be used, for instance, when preparing a 3 component curable polymer fill fluid system as described below.

Figure 3A:
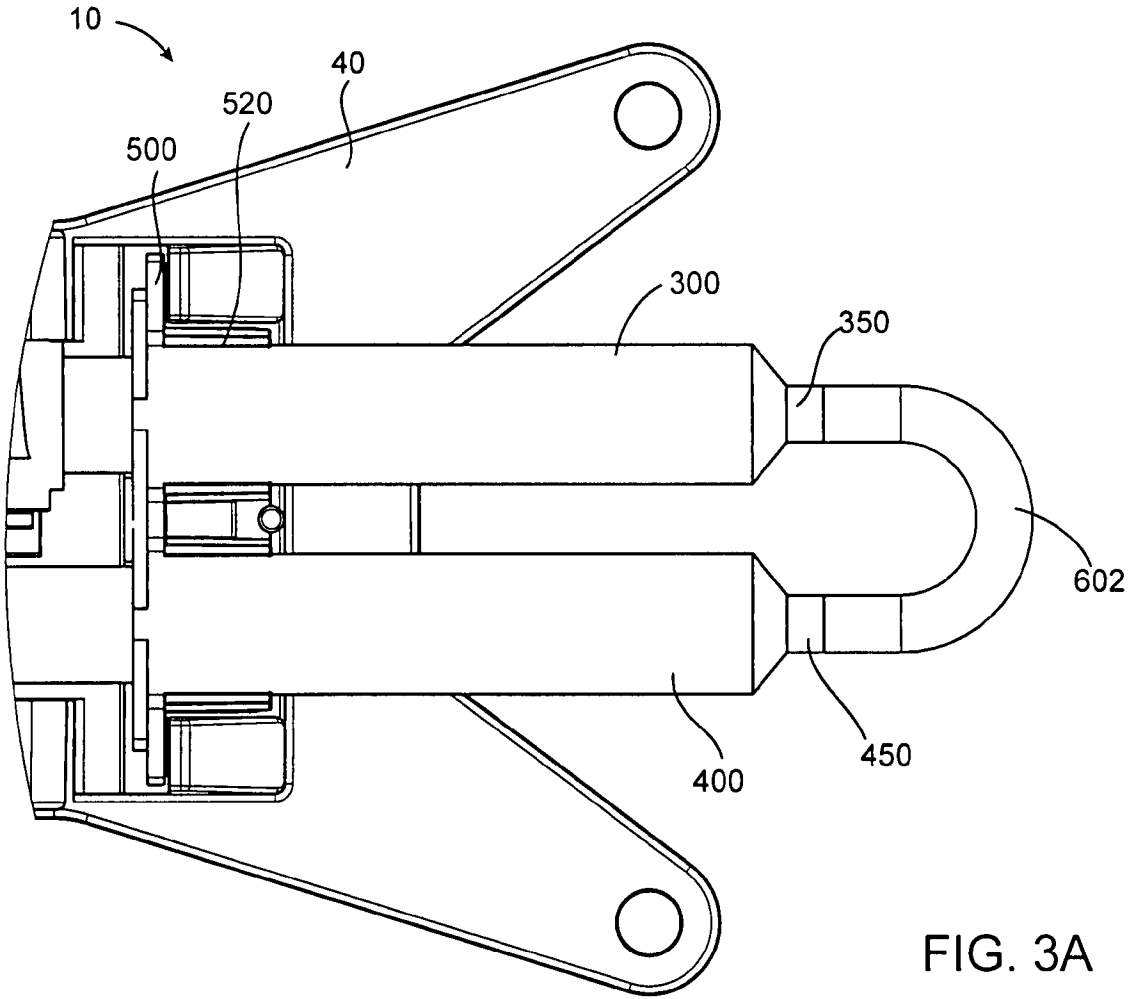
FIG. 3A shows a top view of a portion of a mixing device according to an embodiment of the present invention.
Figure 3B:
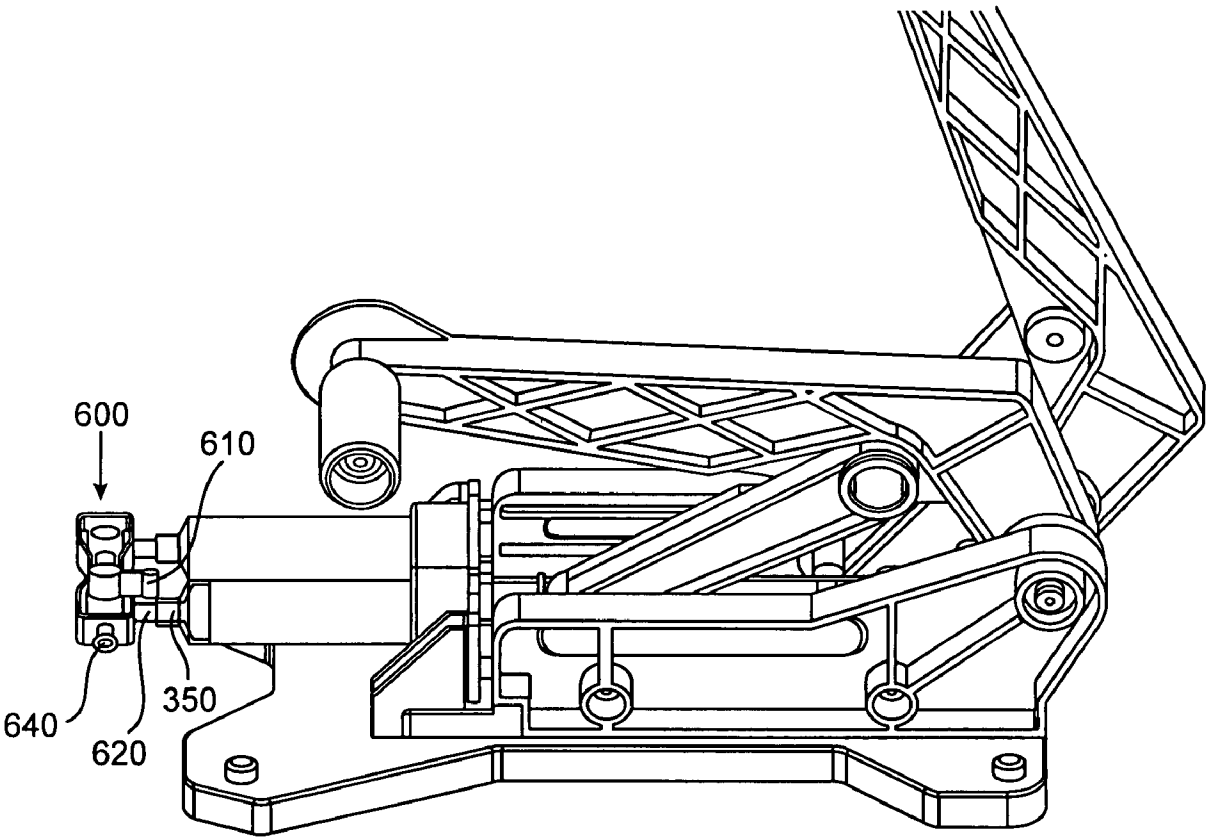
FIG. 3B shows a side perspective view of a mixing device according to an embodiment of the present invention.

FIG. 3A shows a top view of a portion of the device of FIG. 2A, wherein the containers are connected via a tube 602. Fluid or other materials may pass from first syringe 300 through first passage 350 and tube 602, through second passage 450 and into second syringe 400. Likewise, material may pass from second syringe 400 through second passage 450 and tube 602, through first passage 350 and into first syringe 300. As shown in FIG. 3B, manifold 600 can further include at least one stopcock 610 that controls manifold fluid flow. Depending on the setting of stopcock 610, material may be constrained to flow through manifold 600 between a first syringe 300 and a second syringe 400. What is more, material may be allowed to flow from first syringe 300 through manifold 600 and out of vent 640. Similarly, fluid may be allowed to flow from second syringe 400 through manifold 600 and out of vent 640. Material may also flow from both first syringe 300 and second syringe 400 through manifold 600 and out of vent 640.

Figure 4A:
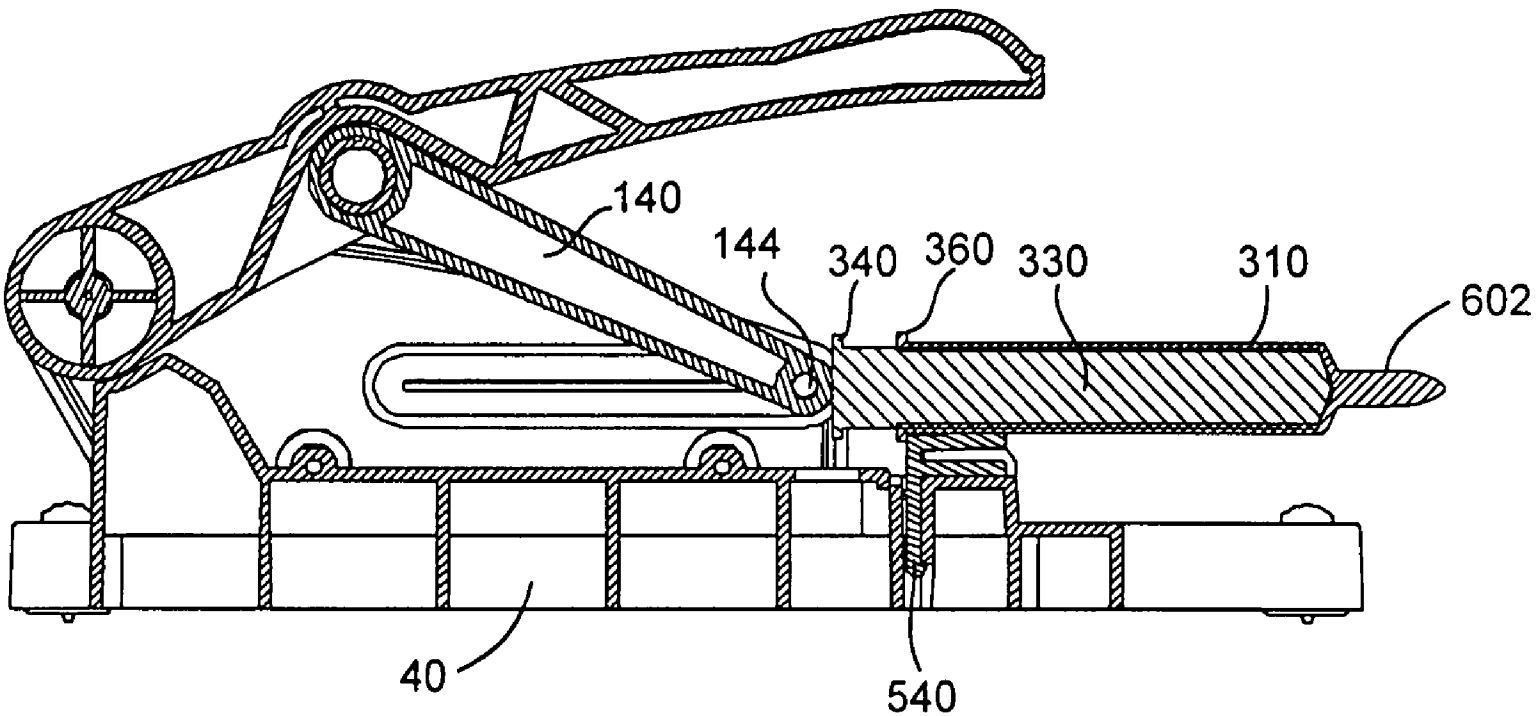
FIG. 4A shows a side cutaway view of a mixing device according to an embodiment of the present invention.
Figure 4B:
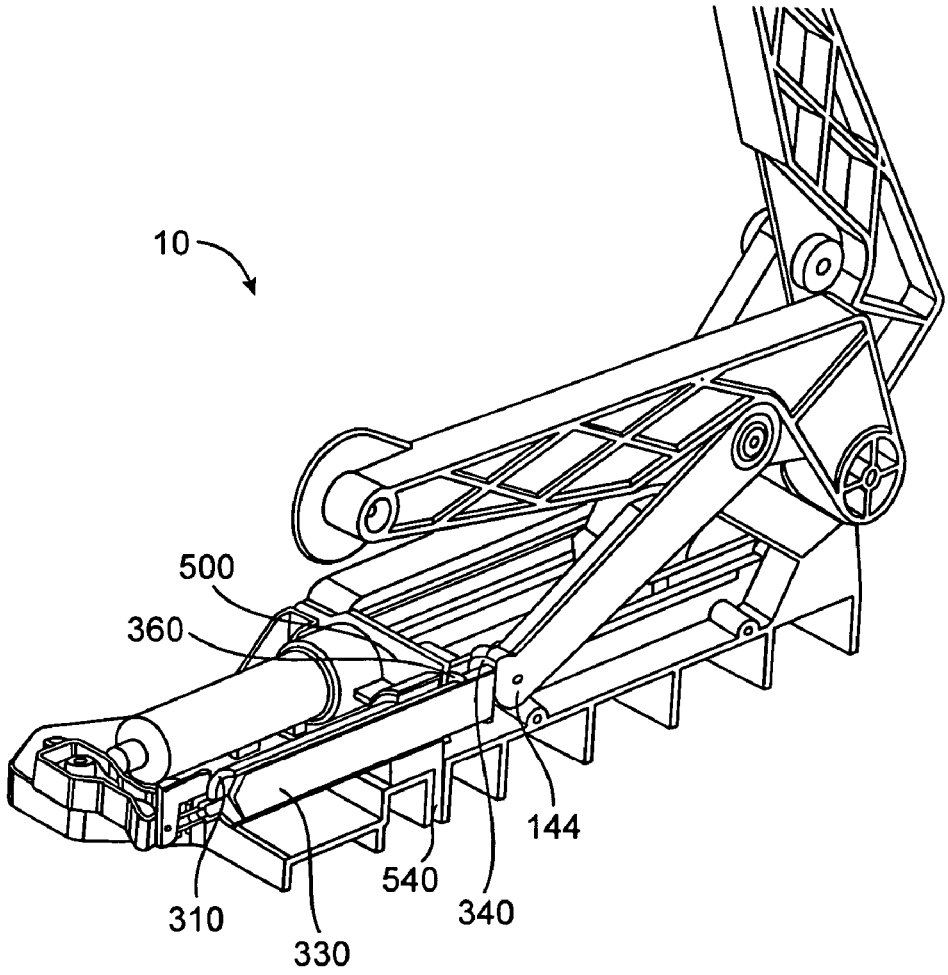
FIG. 4B shows a perspective cutaway view of a mixing device according to an embodiment of the present invention.

FIGS. 4A and 4B depict cutaway views of mixing device 10. First barrel 310 of first syringe 300 can house a first plunger 330 having a first depressor 340. Syringe barrel 310 can be removably or permanently anchored to syringe collar 500 by a first flange 360. Syringe collar 500 may be attached to base 40 in slotted arrangement via a tab 540. It is understood that any of a variety of sizes and configurations of syringes, and syringe collars, may be used. First coupler 140 first end 144 may be adapted to engage first depressor 340, for example, in an abutting relationship as shown in FIGS. 4A and 4B.

Figure 5A:
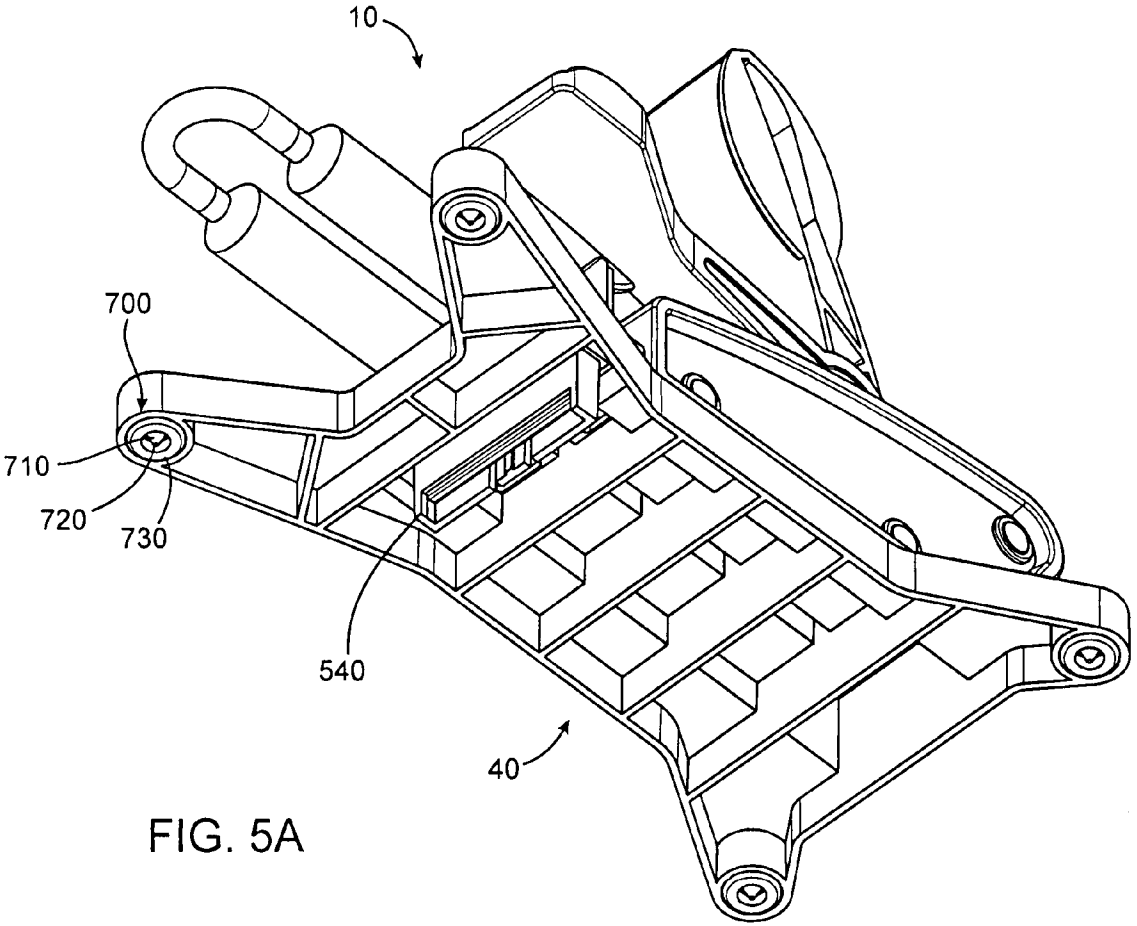
FIG. 5A shows a perspective view of the underside of a mixing device according to an embodiment of the present invention.
Figure 5B:
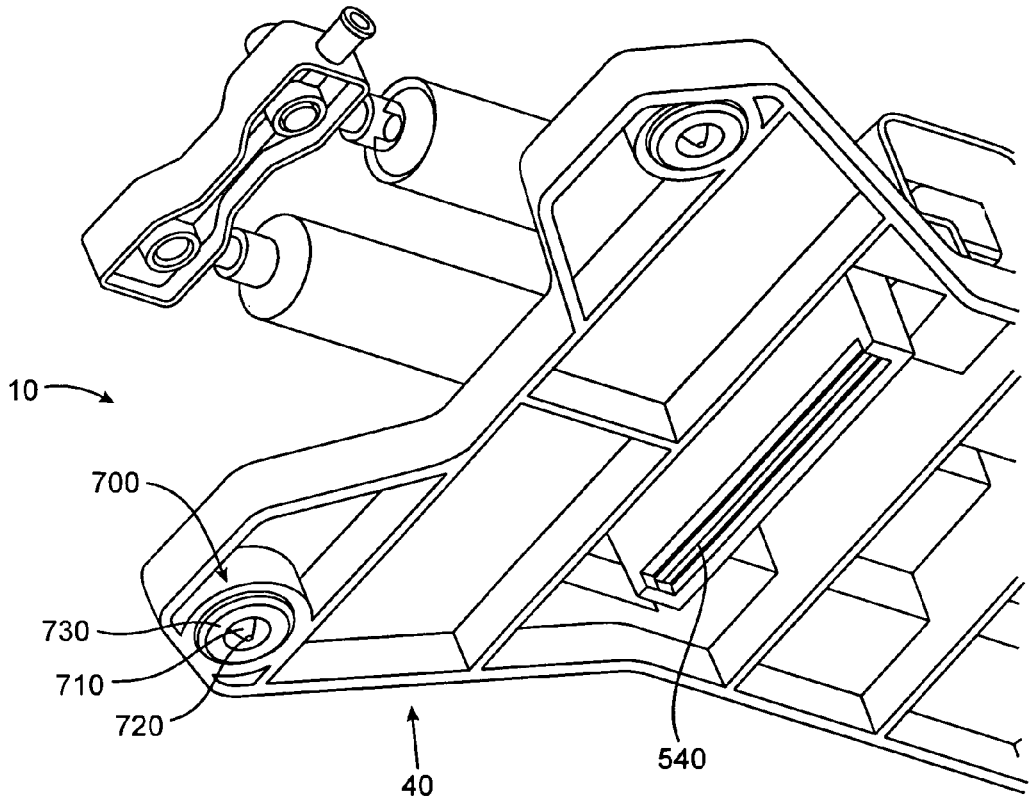
FIG. 5B shows a perspective view of the underside of portion of a mixing device according to an embodiment of the present invention.

FIGS. 5A and 5B are perspective views of the underside of a portion of mixing device 10. Device 10 will often have four or more feet 700. Typically, a resting plane of the base will be situated against a surgical table or other resting surface. The resting plane of base 40 can be defined, for example, by the points at which the base contacts the resting surface. Often, the resting plane of base 40 will be parallel to the resting surface. FIG. 5B depicts two such feet 700 in one section of base 40. Another section of base 40 not shown in FIG. 5B comprises two additional feet for this embodiment, as seen in FIG. 5A. Each foot 700 may be integral with base 40, and may include a conical point 710 having a point tip 720. Often, conical point 710 will be compressible. For example, conical point 710 can be compressible due to a deformable point tip 720. Alternatively, the conical point can include a spring-loaded mechanism that similarly absorbs forces and stabilizes the base upon a resting surface. Although referred to as conical point 710, this element can take any shape, and may not necessarily be conical in form. Foot 700 of FIGS. 5A and 5B further includes a ring surface 730. Often each foot 700 will include a contact patch disposed peripheral or adjacent a conical point or point tip. The contact patch can include ring surface 730. Further, foot 700 can comprise a wide variety of materials, including 60 durometer sanoprene rubber or any other suitable elastomer.

Feet 700 can be configured to produce high point forces on a surface, such as a table top, against or upon which mixing device 10 operates. Often mixing device 10 will be placed on a surgical cloth or other fabric. During use, as the device is situated on such a surface, and as each rocker bar is lowered or actuated by the operator, one or more point tips 720 may slightly penetrate or impress upon the surgical cloth or fabric, thus helping to stabilize mixing device 10. Due to the force applied to the rocker, conical point 710 may be compressed, thus allowing ring surface 730 to contact the table top surface or fabric, and thereby providing stability to prevent or inhibit shifting or "walking" of the device 10 as the alternate application of downward forces of each rocker is applied during mixing of the materials, as will be described in more detail below.

Figure 6:
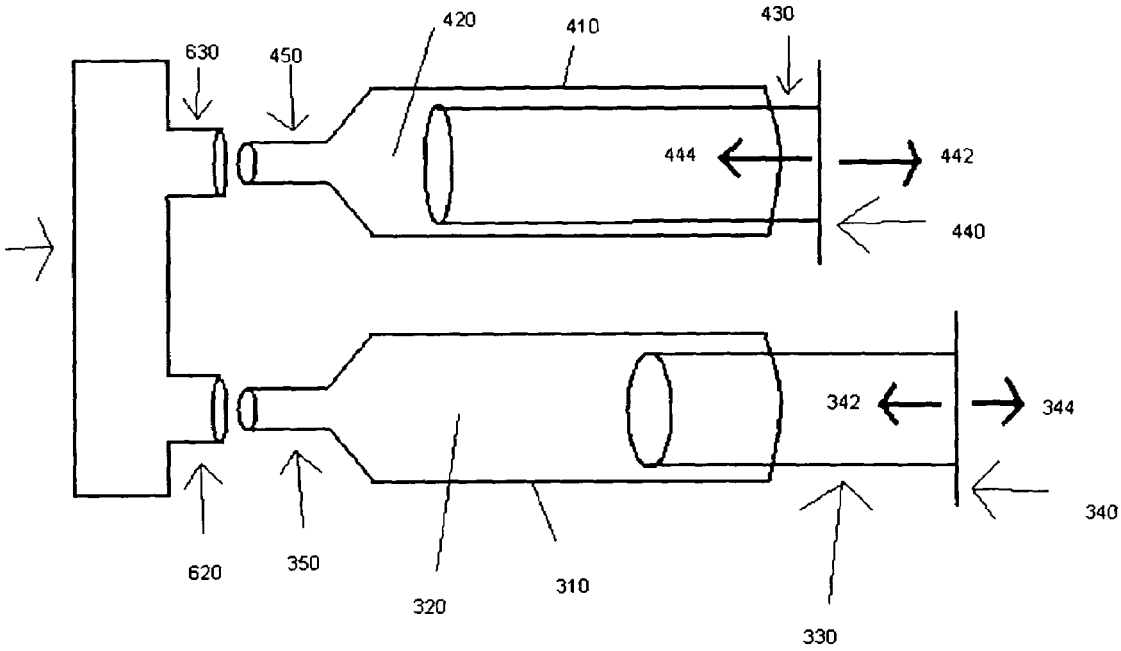
FIG. 6 shows a top view of a portion of a mixing device according to an embodiment of the present invention.

As noted above, the present invention is well-adapted for mixing fluids and other materials by passing them between two containers that are connected via a conduit such as manifold 600 or tube 602. For example, as shown schematically in FIG. 6 with a manifold 600, by loading first chamber 320 with a first material, and second chamber 420 with a second material, it is possible to mix the materials as desired. First linkage 20 is activated as first handle 122 of first rocker 120 is lowered, typically but not necessarily by hand, thus moving sliding end 144 of first coupler 140 against first depressor 340 in the direction shown by arrow 342, thus actuating the plunger. This in turn causes first plunger 330 to move some or all of first material from first chamber 320 through first passage 350, first duct 620, manifold 600, second duct 630, second passage 450 and into second chamber 420, where first material can mix with second material. As first material enters second chamber 420, second plunger 430 is forced away from second passage 450 to accommodate the higher volume of material entering second chamber 420, thus extending second depressor 440 in a direction away from manifold 600 as indicated by arrow 442.

At the end of this sequence in which the first linkage 20 is activated as described above, some or all of the first material is moved from first chamber 320 to second chamber 420, typically resulting in the mixing of at least a portion of the first material and the second material. The degree of mixing achieved after this first and subsequent sequences, including single and multiple mixing sequence iterations, may vary according to numerous parameters, including, for example, the properties of the materials being mixed, the dimensions and physical characteristics of the components shown in the figures (such as the size and interior surface characteristics of chambers 320 and 420 and passages 350 and 450, which among other parameters tend to affect the turbulence of the material as it is being transferred between containers), the configuration of manifold 600 or tube 602, the force used to activate linkage 20, or the ambient temperature and the temperature of the materials. Device 10 may be configured such that complete activation of first linkage 20 through the total available travel of sliding end 144 of first coupler 140 transfers all of the first material from the first chamber 320 to the second chamber 420, ensuring the maximum possible degree of mixing is achieved with each activation sequence of linkage 20. Other configurations, in which only a partial transfer of the first material from first chamber 320 into second chamber 420 is effected by full activation of linkage 20, are within the scope of the present invention.

If desired, first material and second material may be further mixed by lowering a second handle of a second rocker, thus moving or impelling a second sliding end of a second coupler against a second depressor 440 in the direction shown by arrow 444. This in turn causes second plunger 430 to move second material and some or all of first material from second chamber 420, through second passage 450, second duct 630, manifold 600, first duct 620, first passage 350, into first chamber 320. As first and second material pass from second chamber 420 to first chamber 320, they become further mixed. As first and second materials enter first chamber 320, first plunger 330 is forced away from first passage 350 to accommodate the higher volume of material entering first chamber 320, thus extending first depressor 340 away from first barrel 310 in a direction away from manifold 600 as indicated by arrow 442. By alternately actuating first rocker bar 120 and second rocker bar 220, this process can be repeated any number of times, so as to pass some or all of first and second materials back and forth between first chamber 320 and second chamber 420, thus mixing the materials to the degree desired.

It is also possible to use the present invention to mix or agitate a single material, such as a material having multiple components that may have separated out of solution and require further mixing to ensure homogeneity, or to add a gas such as air to a liquid material. For example, a single material can be loaded into first chamber 320 (or alternatively both first chamber 320 and second chamber 420). By operating the first and second linkages as described above, the material can be passed back and forth between first chamber 320 and second chamber 420, thus mixing the material as desired.

Figure 7A:
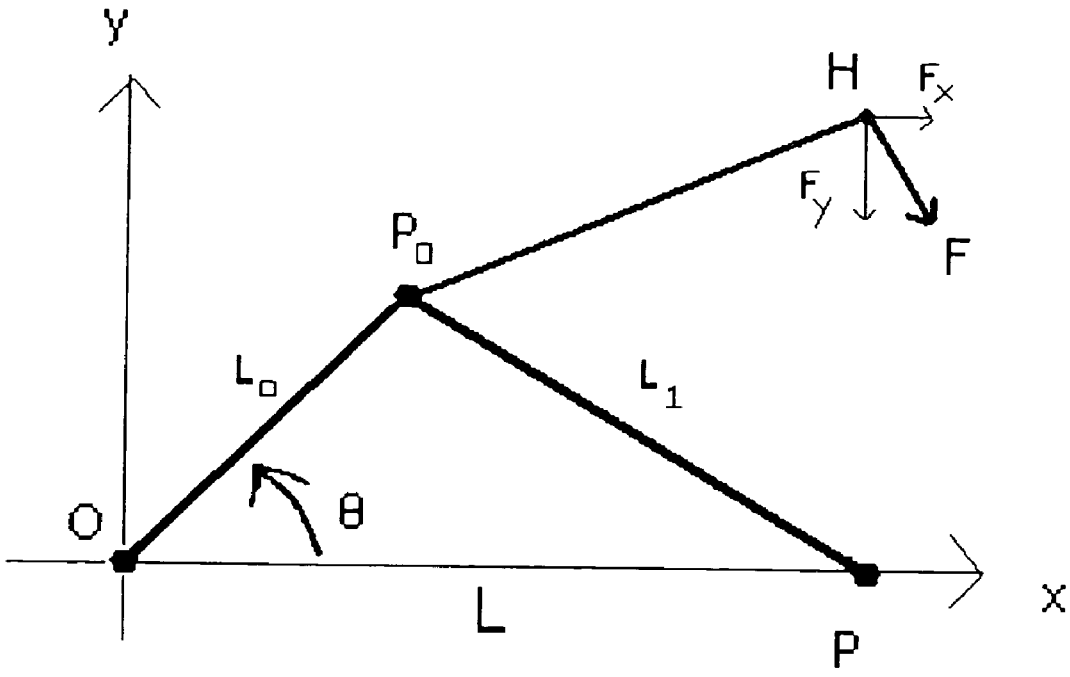
FIG. 7A shows a schematic representation of a linkage geometry according to an embodiment of the present invention.
Figure 7B:
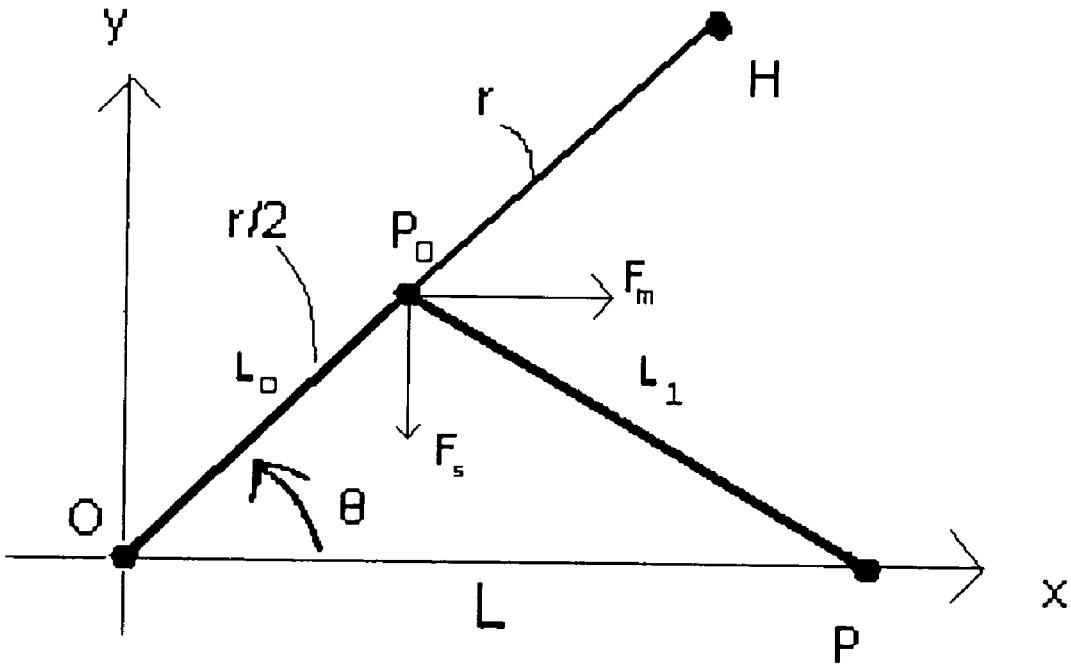
FIG. 7B shows a schematic representation of a linkage geometry according to an embodiment of the present invention.

The present invention may also be configured so as to govern the force vectors required to lower the rocker handles. FIGS. 7A and 7B illustrate skeleton outlines of exemplary linkages according to the principles of the present invention where like reference symbols refer to like features in FIG. 1. The force component of the torque required to lower rocker handle H is shown as vector F, which can contains two component force vectors, a horizontal force component $F_x$ and a vertical force component $F_y$. The linkage may be constructed such that throughout the travel of rocker handle H as it is actuated, the magnitude of the vertical vector $F_y$ is greater than the product of the horizontal force component $F_x$ and the coefficient of friction between the device and the surface upon which the device is situated. In this instance, the configuration ensures that the larger force component is pushing the mixing device downward toward the resting surface or table top.

It may be desirable to construct the linkage geometry such that as each rocker arm is actuated in a downward direction or towards base 40, vertical force component $F_y$ is present in sufficient magnitude to ensure stability so the device does not move or otherwise travel on the resting surface. One approach to constructing the linkage geometry in this fashion is by adjusting the position of the rocker-coupler joint, depicted as $P_0$, at various locations along the length of the rocker arm, which extends from point O to handle H. As the joint $P_0$ becomes closer to point O, the distance $L_0$ decreases, (corresponding to a shorter moment arm), and force F increases, with both $F_x$ and $F_y$ increasing proportionally.

As the rocker arm is activated at the handle H, a corresponding force is transferred to the coupler at point $P_0$. The vector forces acting on point $P_0$ are referred to here as horizontal force vector $F_m$ and vertical force vector $F_s$. A higher relative value for angle θ corresponds to a higher vertical force vector $F_s$. As the handle H is pushed down and the rocker arm is lowered, angle θ becomes smaller. Assuming that a constant force is applied at handle H, the value of vertical force vector $F_s$ consequently becomes smaller and the value of horizontal force vector $F_m$ becomes larger. The relationship between the two vector forces $F_s$ and $F_m$ is sinusoidal. What is more, as the angle θ decreases, the device becomes increasingly stable because less force F is required to maintain the necessary torque to guarantee that $F_m$ is constant. In some cases, the location of $P_0$ can be situated such that as the rocker arm is moved from an up position toward a down position, and the angle θ becomes smaller, the direction of the force transmitted at $P_0$ from the rocker arm to the coupler is aimed to a location disposed between the forward base feet and the rear base feet.

In some instances, the horizontal force vector $F_m$ will remain constant as the rocker arm is lowered, while the vertical force vector $F_s$ decreases. As a result, a decreasing overall force F is required to activate the rocker arm.

The linkage geometry may also be constructed to allow for improved ease of operation. For example, the location of the handle may be adjusted such that when the operator depresses the rocker to the bottom of the stroke, there is ample clearance for the operator's fingers between the handle and the syringe or base.

Figure 8:
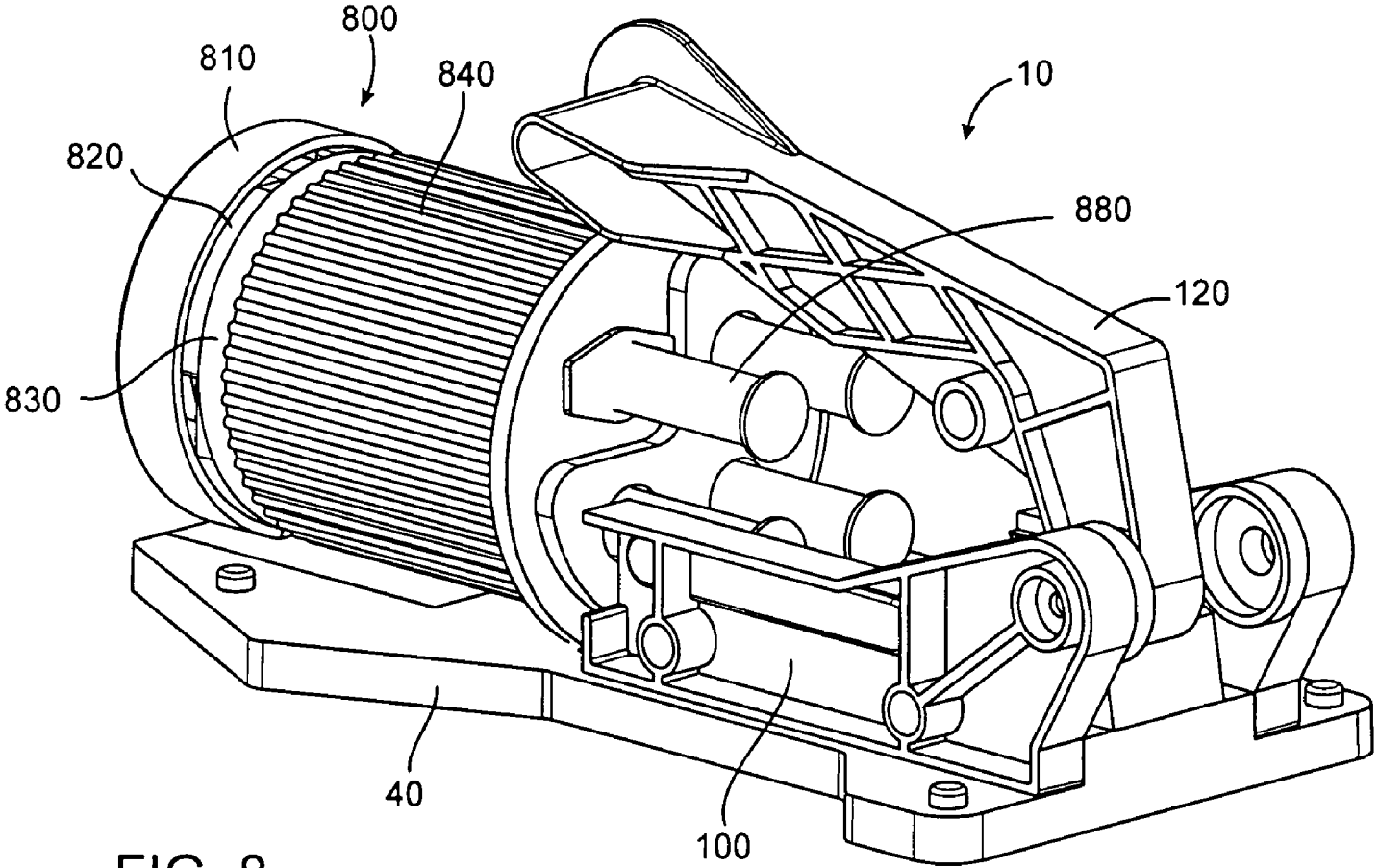
FIG. 8 shows a perspective view of a mixing device according to an embodiment of the present invention.

It is understood that the linkages described herein may be used with any of a variety of mixing assemblies. For example, FIG. 8 shows another embodiment of a mixing device 10 configured for use with four syringes 880. Here, turret 800 includes an optional end cap 810, pawl mount 820, turret manifold 830, and turret cover 840.

Figure 9:
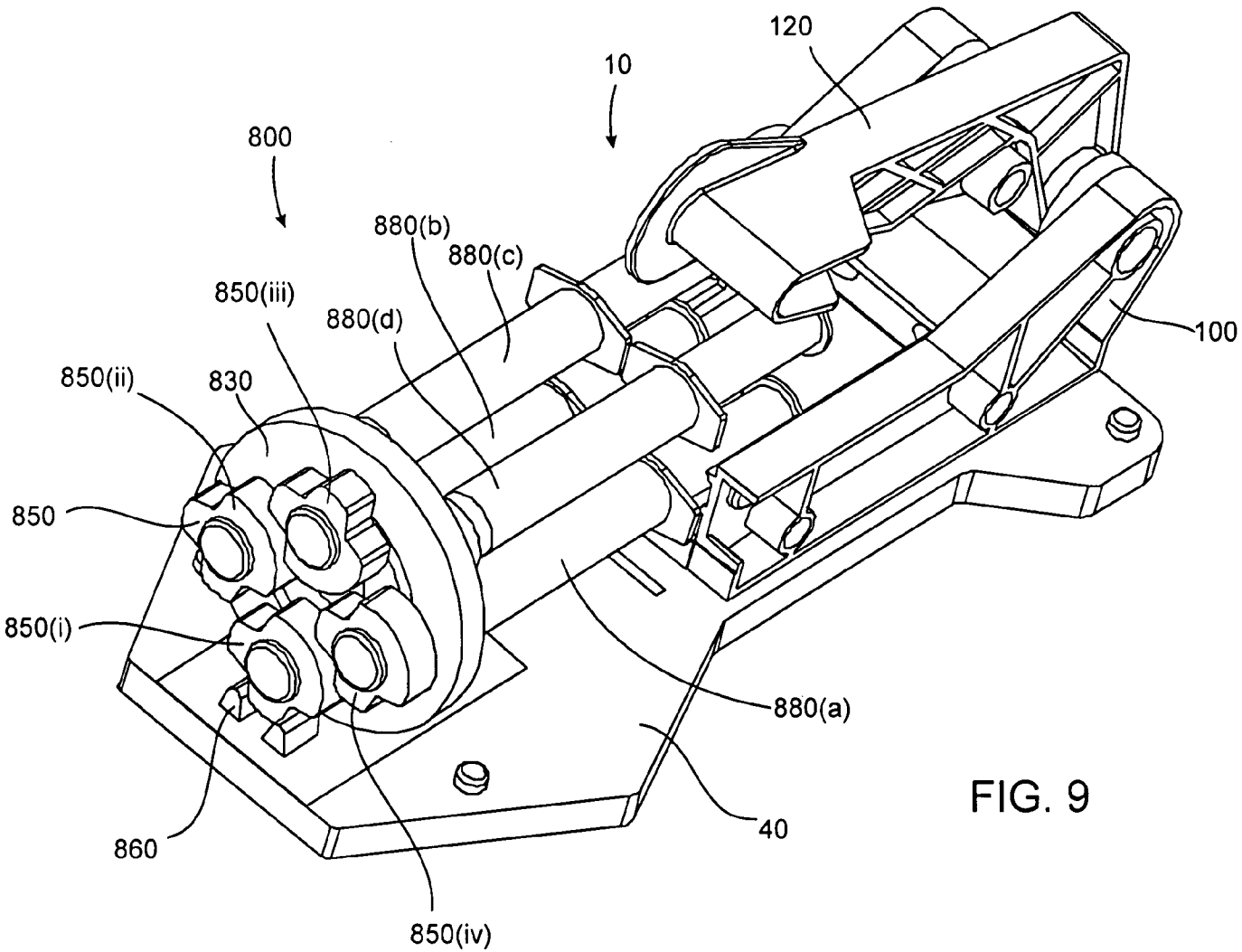
FIG. 9 shows a perspective view of a portion of a mixing device according to an embodiment of the present invention.
Figure 10:
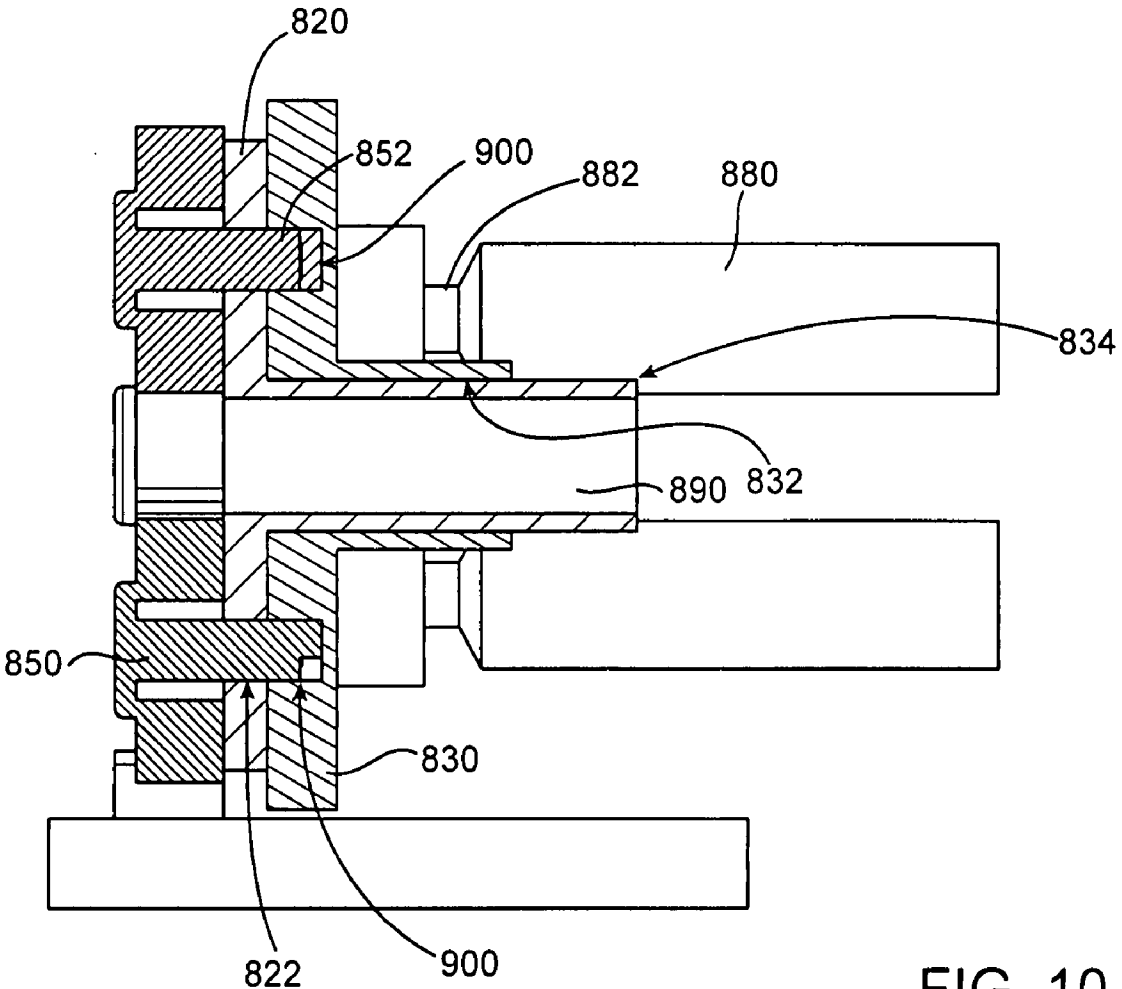
FIG. 10 shows a side cutaway view of a portion of a mixing device according to an embodiment of the present invention.

FIG. 9 illustrates turret 800 with end cap 810 and turret cover 840 removed. A plurality of pawls 850(*i–iv*) are rotatably coupled with pawl mount 820 (not shown) and turret manifold 830. Base 40 is configured with a pawl activator 860. FIG. 10 illustrates a partial cutaway side view showing a mid-line longitudinal section of the turret embodiment front end. Turret manifold 830 may include a plurality of recesses 900, each adapted to receive a pawl pivot 852 configured to pass through a corresponding aperture 822 in pawl mount 820. Pawl mount 820 can include a pawl mount extension 890 that extends through a central aperture 832 of turret manifold 830, and is housed within a turret manifold flange 834.

Figure 11:
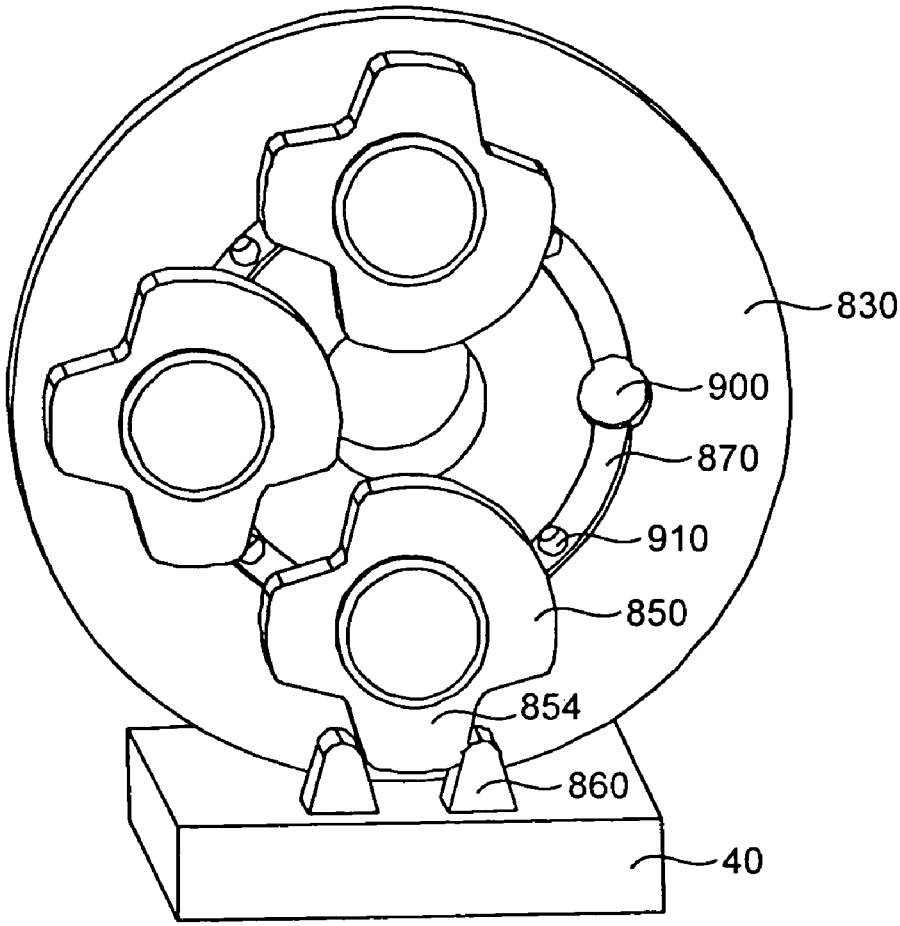
FIG. 11 shows a perspective view of a portion of a mixing device according to an embodiment of the present invention.
Figure 12A:
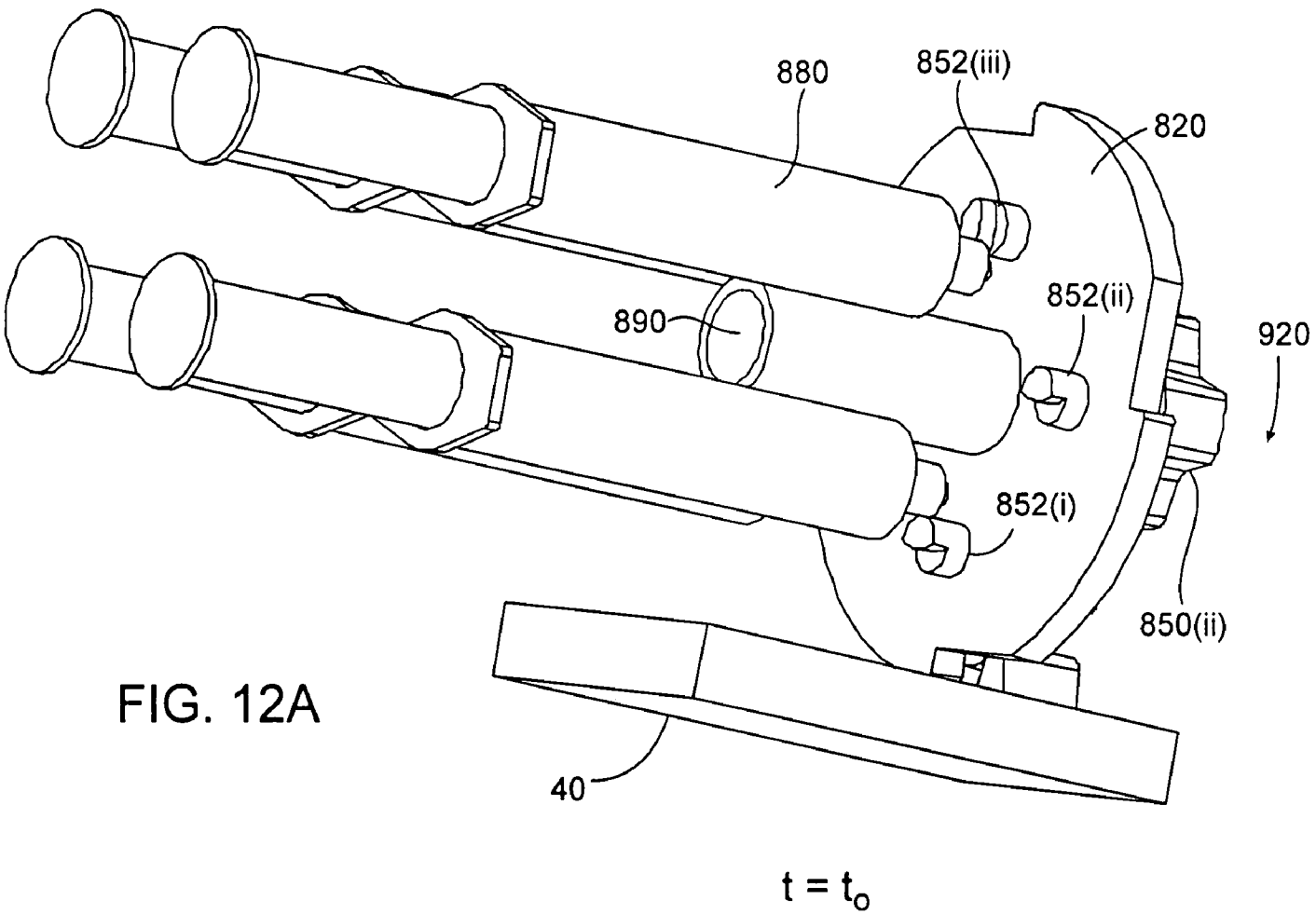
FIG. 12A shows a perspective view of a portion of a mixing device according to an embodiment of the present invention.

Referring to FIG. 11, turret manifold 830 can include a channel 870, a plurality of recesses 900, and a plurality of ducts 910. Ducts 910 may be configured to be in operative association with syringe passages 882 (not shown). Pawl 850 can include a plurality of cogs 854 for operative association with pawl activator 860. For illustration purposes, pawl mount 820 is not shown in this figure. As shown in FIG. 12A, pawl pivots 852 can be oriented in a "closed" position 852(*a*) and an "open" position 852(*b*). The open position can be rotated 90° relative to the closed position, as shown by the pawl pivot 852 proximal to base 40. For illustration purposes, turret manifold 830 is not shown in this figure.

Figure 12B:
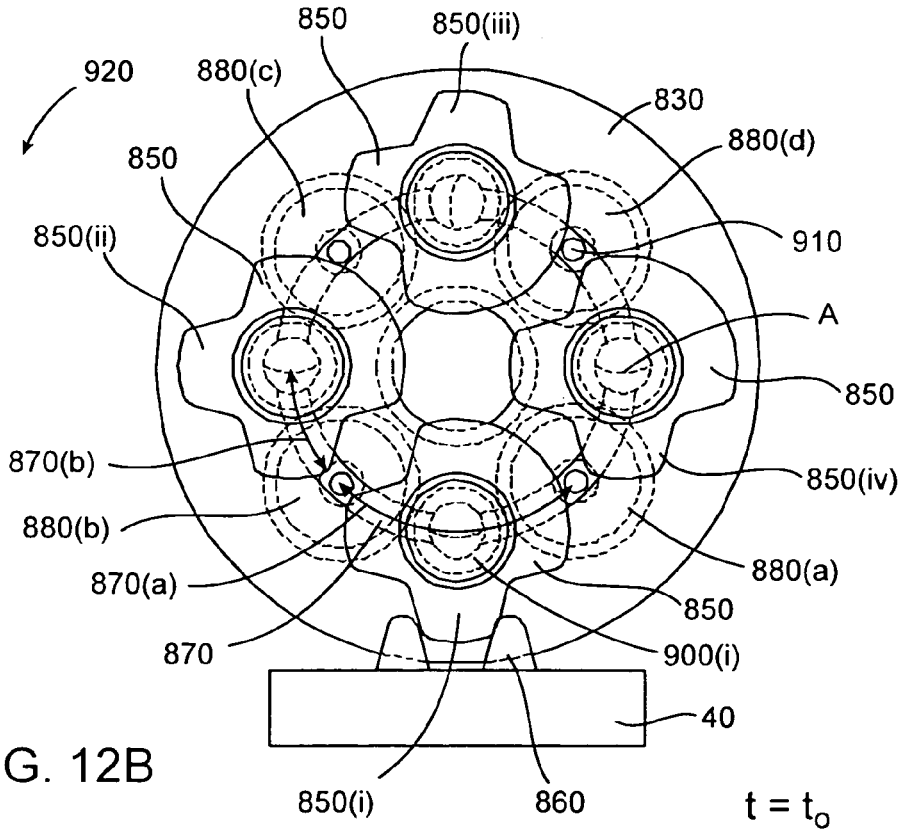
FIG. 12B shows an end view of a portion of a mixing device according to an embodiment of the present invention.

FIG. 12B depicts a front view of turret manifold 830, pawls 850, and a portion of base 40, and corresponds to the views of FIGS. 9, 11, 13A, and 14. Other features have been removed or, in the case of containers or syringes 880, for example, are shown in phantom to illustrate their location with respect to ducts 910 and other features as seen in FIG. 12B. The pawls 850, pawl pivots 852, and recesses 900 of FIG. 12B are configured in the following locations and orientations:

| Pawl | Pawl Pivot | Location | Orientation | Recess |
|---|---|---|---|---|
| 850(i) | 852(i) | 6 o'clock | open | 900(i) |
| 850(ii) | 852(ii) | 3 o'clock | closed | 900(ii) |
| 850(iii) | 852(iii) | 12 o'clock | closed | 900(iii) |
| 850(iv) | 852(iv) | 9 o'clock | closed | 900(iv) |

Figure 12C:
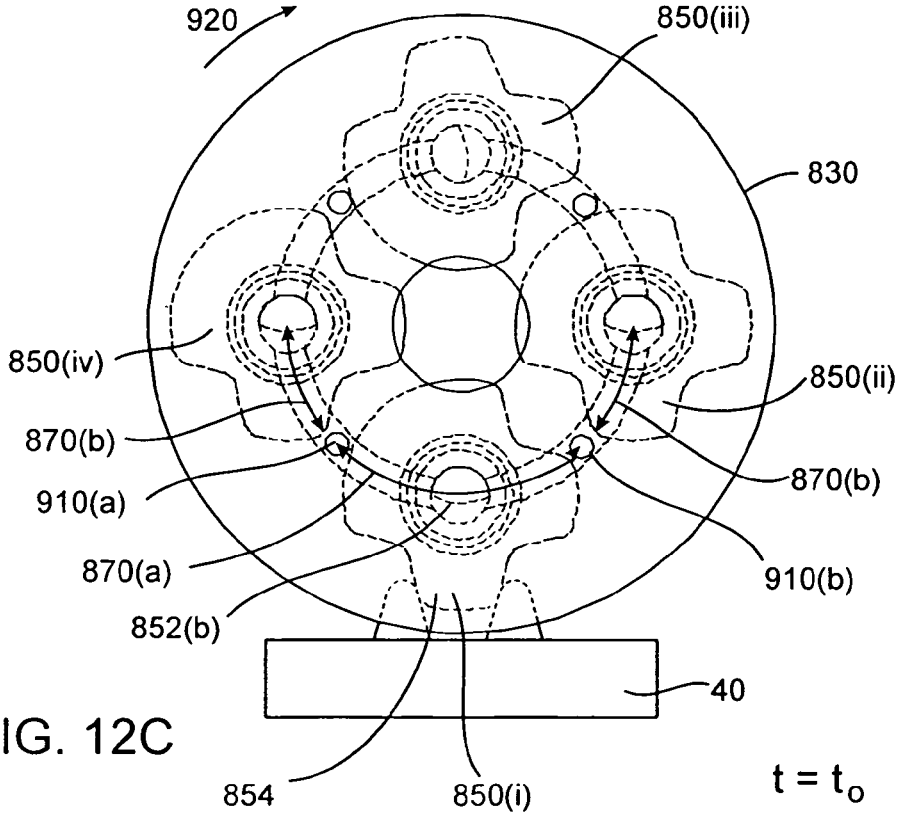
FIG. 12C shows another end view of a portion of a mixing device according to an embodiment of the present invention.

FIG. 12C is a rear view of turret manifold 830 and pawls 850, such that when compared to FIG. 12B the top and bottom pawls 850(*iii*) and 850(*i*) appear in the same locations but the locations of pawls 850(*ii*) and 850(*iv*) appear reversed. FIG. 12C corresponds to the perspective view of FIG. 12A. As will be further discussed below, in this configuration in which 6 o'clock pawl 850(*i*) and pawl pivot 852(*i*) are in an open orientation 852(*b*), material can flow between the two lowermost ducts 910(*a*) and 910(*b*) via a section of channel 870 extending therebetween as demarcated by arrow 870(*a*). Flow elsewhere in channel 870 outside of section 870(*a*) is restricted and limited, by the closed orientation 852(*a*) of pawls 850(*ii*) and 850(*iv*) and corresponding pawl pivots 852(*ii*) and 852(*iv*), respectively, to a section of channel 870 indicated (shown in FIG. 12B as being on one side only for ease of illustration) by arrow 870(*b*).

Referring now to FIG. 9, each of four syringes 880(*a*), 880(*b*), 880(*c*), and 880(*d*) may contain material components to be mixed in a prescribed fashion, which may include any combination of designated mixing sequences and durations. For example, a mixing sequence may begin with the mixing of contents of syringe 880(*a*) with 880(*b*), where syringe 880(*a*) is in working association with first linkage (partially shown) and syringe 880(*b*) is in working association with second linkage 20 (not shown). By operating first linkage and second linkage 30 of mixing device 10 as previously described, it is possible to mix the contents of the syringes by alternately manipulating first and second rockers. In this configuration, syringes 880(*a*) and 880(*b*) are disposed immediately adjacent base 40, in the lower position, while syringes 880(*c*) and 880(*d*) are in the upper position, and not in working association with first and second linkages.

FIGS. 9–12 are instructive in showing how material can flow through channel 870 of turret manifold 830 between syringes 880(*a*) and 880(*b*). When pawl 850(*i*) is in the lower position immediately adjacent base 40, syringes 880(*a*) and 880(*b*) are also in a lower position (FIG. 9). In this configuration, cog 854 of pawl 850(*i*) has rotatably engaged pawl activator 860 (FIGS. 11 and 12C) such that pawl pivot 852(*i*) of pawl 850(*i*) is in open position 852(*b*) while each of the other pawls pivots 852(*ii*–*iv*) is in closed position 852(*a*) (FIGS. 12A–C). As noted above, when in the open position, pawl pivot 852(*i*) allows material flow through corresponding recess 900 of channel 870 between the two lower ducts 910(*a*) and 910(*b*), while the other pawl pivots 852(*ii* and *iv*) block material flow through their corresponding recesses 900 (FIGS. 12B and 12C) due to their being in the closed position 852(*a*). Thus, as first linkage is activated, material flows from syringe 880(*a*), through corresponding passage 882(*a*), duct 910(*a*), a portion of channel section 870(*a*), open recess 900(*i*), another portion of channel section 870(*a*), duct 910(*b*), passage 882(*b*) (not shown), and into syringe 880(*b*). The material from syringe 880(*a*) can then mix with the material in syringe 880(*b*) as previously described.

To further mix the materials, the second linkage can be activated, thereby moving the materials from syringe 880(*b*) to syringe 880(*a*) via the reverse route. As described previously, by alternately operating the first and second linkages, this process can be repeated any number of times, so as to pass materials back and forth between syringes 880(*a*) and 880(*b*), hence mixing the materials to the degree desired.

When the materials of syringes 880(*a*) and 880(*b*) have been mixed as desired, the combined contents can then be mixed with material from syringe 880(*c*) as follows. The mixed materials of syringes 880(*a*) and 880(*b*) can be transferred to syringe 880(*b*) by manipulating first and second rockers. By then rotating turret 800 by 90 degrees in a counterclockwise direction as shown by arrow 920 (FIG. 13A), syringes 880(*b*) and 880(*c*) now occupy the lower positions, and syringes 880(*a*) and 880(*d*) occupy the upper positions. In this configuration, pawl 850(*ii*) is now in the 6 o'clock location and oriented such that corresponding pawl pivot 852(*ii*) is in open position 852(*b*) and the other pawl pivots 852(*i, iii, iv*) are in closed position 852(*a*). This now allows a route of communication through manifold 830 between syringes 880(*b*) and 880(*c*). Thus, by operating first and second linkages as described above, the previously mixed contents from syringes 880(*a*) and 880(*b*), now contained in syringe 880(*b*), can be mixed with the contents of syringe 880(*c*) as desired. Thereafter, turret 800 can be rotated another 90 degrees in the direction shown by arrow 920, such that syringes 880(*c*) and 880(*d*) now occupy the lower positions, and syringes 880(*a*) and 880(*b*) occupy the upper positions. In this configuration, pawl 850(*iii*) is oriented such that corresponding pawl pivot 852(*iii*) is in open position 852(*b*) and the other pawl pivots 852(*i, ii, iv*) are in a closed position 852(*a*). This now allows a route of communication through manifold 830 between syringes 880(*c*) and 880(*d*). Thus, by operating first and second linkages as described above, the previously mixed contents from syringes 880(*a*), 880(*b*), and 880(*c*), now contained in syringe 880(*c*), can be mixed with the contents of syringe 880(*d*) as desired.

Figure 13A:
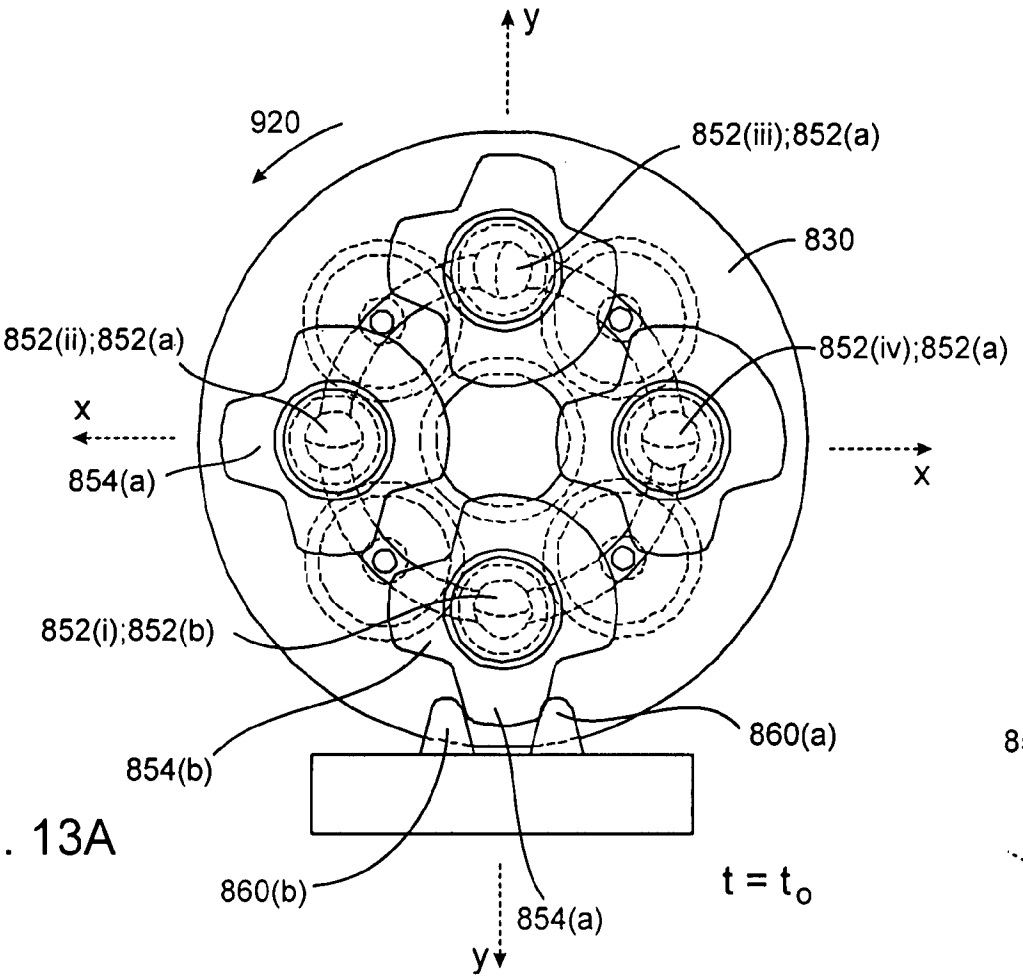
FIG. 13A shows an end view of a portion of a mixing device according to an embodiment of the present invention.
Figure 13B:
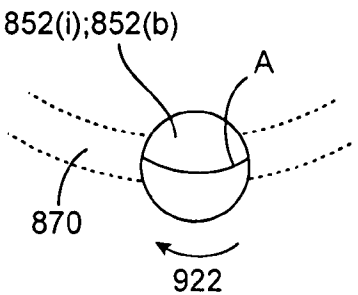
FIG. 13B shows a schematic representation of a pawl pivot according to an embodiment of the present invention.

FIG. 13A, which illustrates a front view of turret manifold 830 and pawls 850, and FIG. 13B will now be referred to in conjunction with a discussion of how pawls 850 operate with pawl activator 860 to effect an open or closed position of the corresponding pawl pivots 852. In this configuration, pawl pivot 852(*i*) is in open position 852(*b*), whereas pawl pivots 852(*ii, iii, iv*) are in closed position 852(*a*). As depicted in the inset view of FIG. 13B, pawl pivot 852(*i*) comprises a pawl pivot face A that is generally transverse to vertically oriented axis y, whereas pawl pivots 852(*ii, iii, iv*) comprise pawl pivot faces A that are generally parallel to or coincident with either the horizontally-oriented axis x (for pawl pivots 852(*ii* and *iv*)) or axis y (for pawl pivot 852(*iii*)). In use, after the material contained in the two lower containers or syringes have been mixed as desired and transferred to a single container or syringe, turret manifold 830 is rotated 90 degrees in a counterclockwise direction, as indicated by arrow 920. Both the location and the orientation of pawls 850(*i*) and 850(*ii*) and their corresponding pawl pivots change as follows. As pawl 850(*i*) moves from the 6 o'clock location toward the 3 o'clock location, pawl pivot cog 854(*a*) of pawl 850(*i*) engages pawl activator 860(*a*), causing individual rotatably mounted pawl 850(*i*) to rotate 90 degrees in a clockwise direction about its own axis as indicated by arrow 922 in FIG. 13B. Consequently, corresponding pawl pivot 852(*i*) changes its orientation from the open position 852(*b*) to the closed position 852(*a*), with pawl pivot face A becoming generally parallel to or coincident with axis x. The closed position 852(*a*) of pawl pivot 852(*i*) at the 3 o'clock location now prevents material from flowing through the corresponding recess 900(*i*) beyond channel section 870(*b*) as previously described in conjunction with FIGS. 12A and 12B.

As pawl 850(*ii*) simultaneously moves from the 9 o'clock location to the 6 o'clock location when turret manifold 830 rotates counterclockwise 90 degrees, pawl pivot cog 854(*a*) of pawl pivot 850(11) engages pawl activator 860(*b*), causing individual rotatably mounted pawl 850(*ii*) to rotate 90 degrees in a clockwise direction about its own axis. Consequently, corresponding pawl pivot 852(*ii*) changes orientation from the closed position 852(*a*) to the open position

852(*b*), with pawl pivot face A becoming generally parallel to or coincident with axis x when at the 6 o'clock location. Although this example indicates rotation of turret manifold 830 in a counterclockwise direction, it may be configured for clockwise rotation. Note also that pawl pivot face A needs only to become oriented sufficiently parallel to or coincident with axis x such that material from the lowermost syringes may cross through the lowermost recess 900 so to communicate through channel section 870(*a*) as previously described. Therefore, it is within the scope of the present invention that the profile or shape of pivot face A may take on any configuration or profile sufficient to block or permit material movement, as the case may be, through channel 870 as its corresponding pawl 850 and pawl pivot 852 rotates on its own axis via engagement with pawl activator 860.

Figure 14:
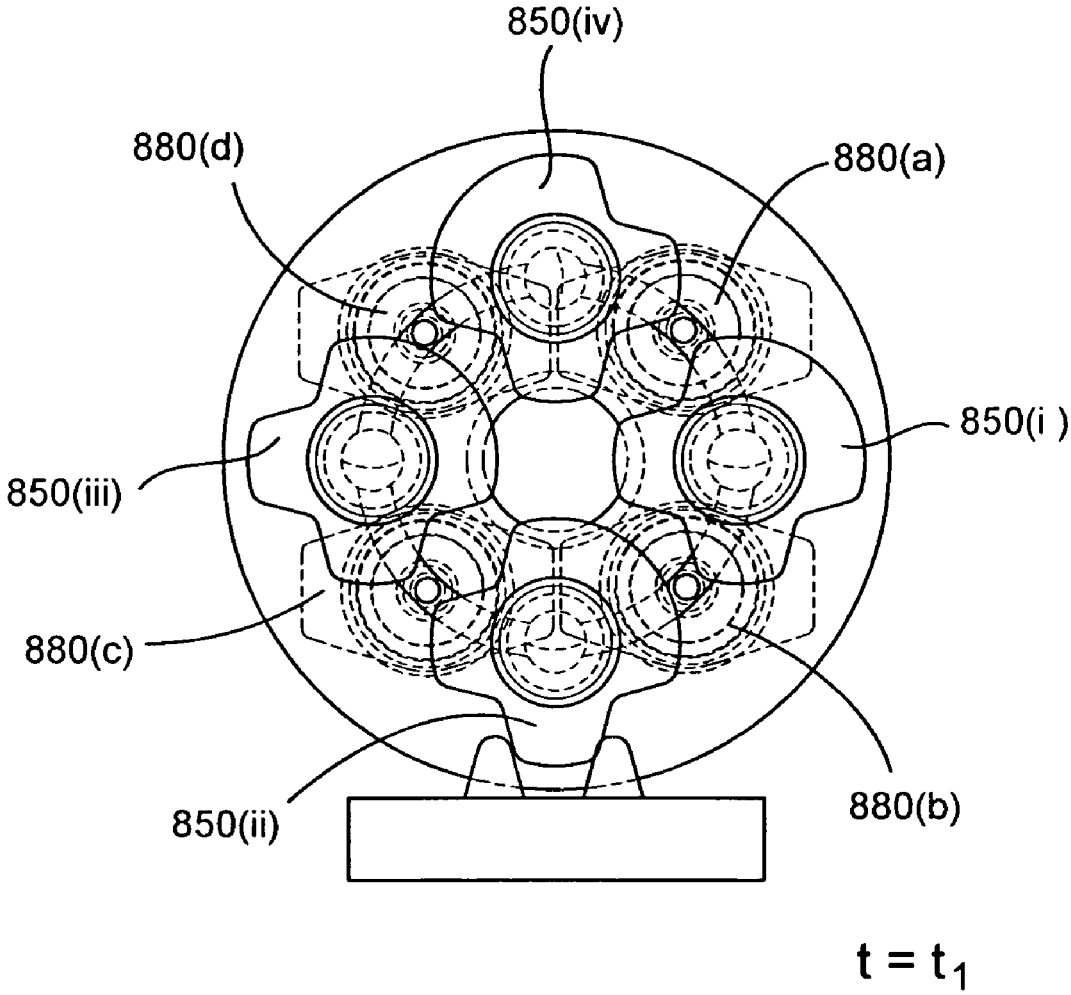
FIG. 14 shows an end view of a portion of a mixing device according to an embodiment of the present invention.

Whereas FIG. 13A depicts the location and orientation of pawls at time $t_0$ prior to rotation of turret manifold 830, FIG. 14 shows the pawls at time $t_1$ after the turret manifold 830 has rotated 90 degrees in a counterclockwise direction such that pawl 850(*i*) which was at the 6 o'clock location at time to is now at the 3 o'clock location at time $t_1$. In this configuration, materials are allowed to pass between syringes 880(*b*) and 880(*c*). Each of pawls 850(*i*) and 850(*ii*), having been rotated by engagement with pawl activator 860, are now rotated 90 degrees in a clockwise direction about their own axes relative to that shown in FIG. 13A. The pawls 850, pawl pivots 852, and recesses 900 of FIG. 14 are configured in the following locations and orientations at time $t_1$:

| Pawl | Pawl Pivot | Location | Orientation | Recess |
|---|---|---|---|---|
| 850(i) | 852(i) | 3 o'clock | closed | 900(i) |
| 850(ii) | 852(ii) | 6 o'clock | open | 900(ii) |
| 850(iii) | 852(iii) | 9 o'clock | closed | 900(iii) |
| 850(iv) | 852(iv) | 12 o'clock | closed | 900(iv) |

Although not explicitly shown in the figures, as turret manifold is further rotated 90 degrees in the clockwise direction, corresponding to time $t_2$, device 10 is so configured to allow material to flow between syringes 880(*c*) and 880(*d*). Thus, at time $t_2$, the pawls 850, pawl pivots 852, and recesses 900 are configured in the following locations and orientations:

| Pawl | Pawl Pivot | Location | Orientation | Recess |
|---|---|---|---|---|
| 850(i) | 852(i) | 12 o'clock | closed | 900(i) |
| 850(ii) | 852(ii) | 3 o'clock | closed | 900(ii) |
| 850(iii) | 852(iii) | 6 o'clock | open | 900(iii) |
| 850(iv) | 852(iv) | 9 o'clock | closed | 900(iv) |

As depicted in this embodiment, each pawl 850 comprises two adjacent pawl cogs 854. The absence of similar pawl cogs on the opposing side of the pawl prevents further cooperation between the pawl and the pawl activator. In use, this means that only one cycle of mixing between each of the containers is allowed, as this configuration of the pawls 850 allows turret manifold 830 to complete only one half of a revolution, but not three quarters of a revolution. This corresponds to a 90 degree rotation between times $t_0$, and $t_1$, and a subsequent 90 degree rotation between times $t_1$ and $t_2$. In other words, beyond time $t_2$, as pawl 850(*iv*) moves from the 9 o'clock location toward the 6 o'clock location, the pawl cog orientation of pawl 850(*iv*) prevents pawl 850(*iv*) from engaging pawl activator 860, and thus turret manifold 830 is prevented from completing a third 90 degree rotation. For this four syringe embodiment, two ninety degree rotations are sufficient to provide for the mixing of a four component composition. The contents of the syringes can be mixed in any order desired, and this order can be determined based on, for example, the rotation direction of the manifold. At the end of the mixing sequence, the entire mixed contents of all four syringes can be transferred to a single syringe, thus providing one filled syringe and three empty syringes. This is sufficient for the four syringe configuration shown in the example of this alternative embodiment to allow an operator to completely mix and transfer the contents of four syringes to a single syringe in a specific sequence.

The turret manifold embodiment allows for simple and convenient mixing of a predetermined number n (where n may be between 2 and 8 or higher, inclusive) of different materials; for instance, four materials (n=4) as shown in the embodiment of FIGS. 8–16. The rotating turret feature of this embodiment ensures that these materials are mixed in specific sequences. This significantly reduces the potential for errors in the mixing sequence as the device 10 can be pre-loaded with the materials in the syringes, placed in a tamper-proof manner into device 10 (e.g., with turret cover 840 preventing easy access to the syringes). In addition, this embodiment of device 10 may be configured so that turret manifold 830 can only rotate in one direction so that the materials in the syringes are mixed in the order required. This approach can be useful in mixing certain multi-component compounds, such as polymer mixtures in which the sequence of mixing is critical to the performance of the resulting mixture as described by example below.

Figure 15:
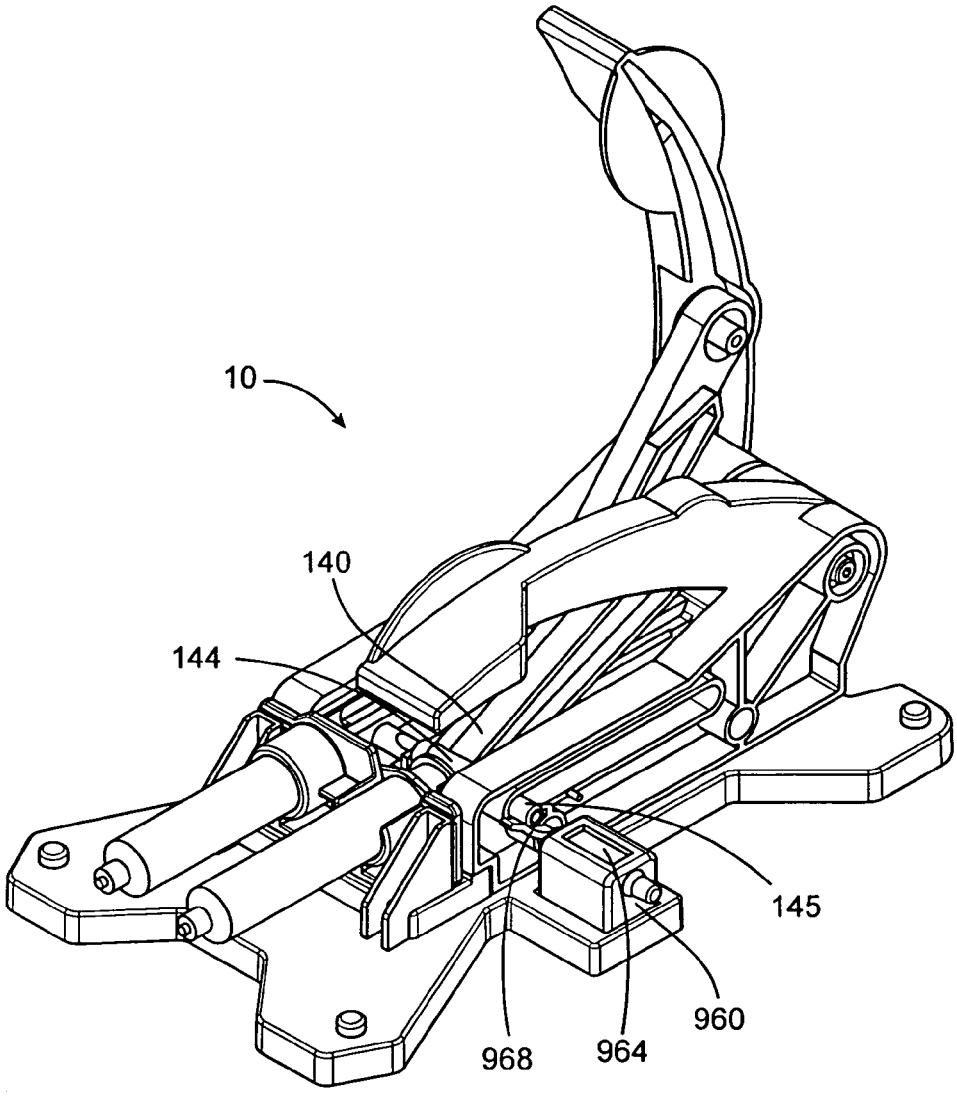
FIG. 15 shows a perspective view of a mixing device according to an embodiment of the present invention.
Figure 16:
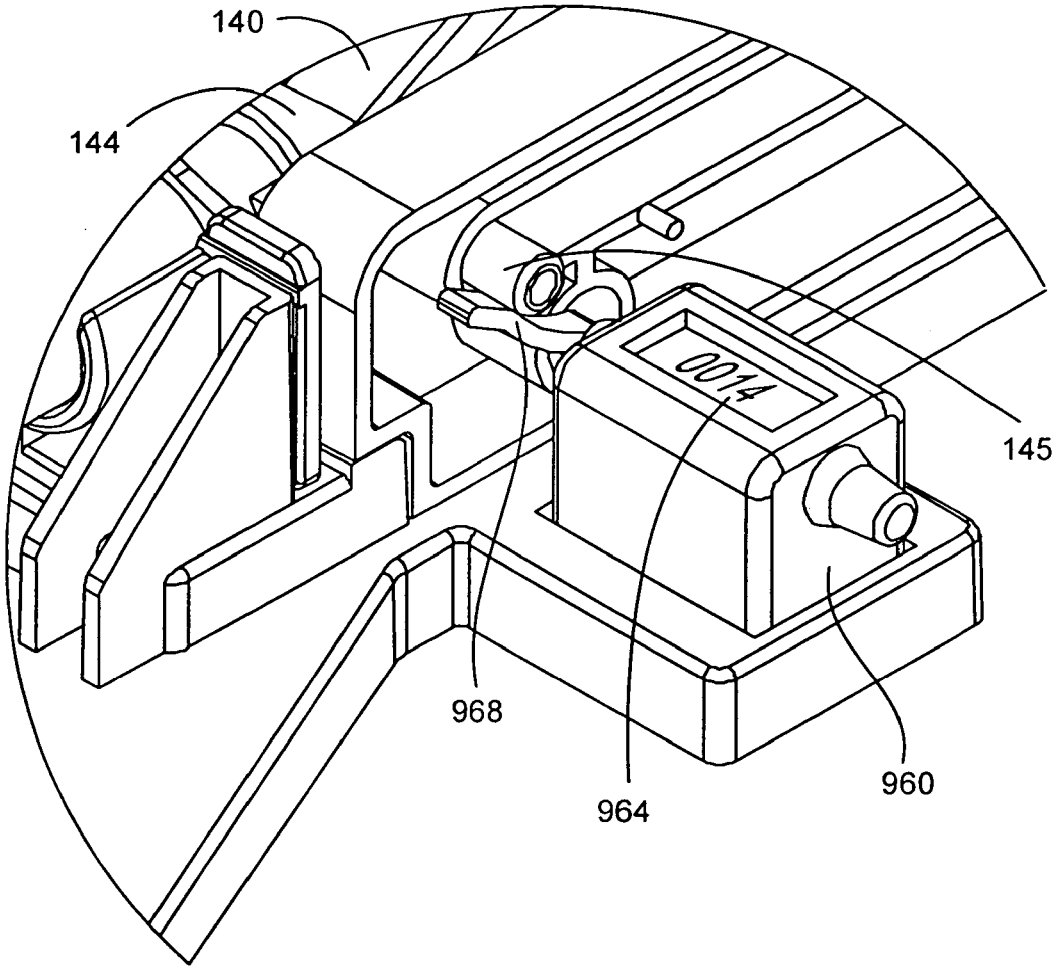
FIG. 16 shows a perspective view of a portion of a mixing device according to an embodiment of the present invention.

As shown in FIGS. 15 and 16, the turret embodiment of mixing device 10 can include optional features such as counter 960, count indicator 964, and counter activation lever 968. First end 144 of coupler bar 140 can be coupled with a catch 145 such that when first linkage is actuated, catch 145 can engage counter activation lever 968. This allows the operator to use the counter to monitor the number of mixing strokes applied to the mixing device. In addition to mechanical counters, the present invention can include electrical and optical counters. Mechanical counters, in some cases, can be economically manufactured as compared with electrical and other counters. The mixing device can also be configured with a timer to allow the operator to track the duration of mixing times. A timer can be useful when mixing materials that require a specific mixing time to ensure consistency. The device can be constructed such that a timer is actuated by the first rocker arm actuation, or by any other desired event. Moreover, the timer can be constructed integrally with or separate from the counter. These features can assist the operator in avoiding errors in mixing times and sequences. The embodiment of FIGS. 2A–5B may also comprise a timer and/or counter mechanism.

Both embodiments of the present invention enable a reliable method for mixing n materials in sequence to mix an n-component solution, in which materials are successively transferred to a single chamber that accumulates the mixed materials until all n materials are mixed together.

The present invention is well suited for mixing a variety of materials, including epoxies, adhesives, polymers, biological materials such as bone pastes and tissue sealants, and any of a variety of gels, foams, powders, fluids (including both liquids and gases), cements, and the like. One particular application of device 10 is in mixing a multiple-component polymer system suitable for use in a number of medical applications, such as filling body cavities or voids, for example fallopian tubes, blood vessels, or bile ducts, or filling inflatable medical devices, for example space-filling members and endovascular grafts. Such applications are described in greater detail in pending U.S. patent application Ser. No. 10/327,711 to Chobotov et al. filed Dec. 20, 2002 and entitled "Advanced Endovascular Graft". One useful curable polymer system is described in general in pending U.S. patent application Ser. No. 09/496,231 to Hubbell et al., filed Feb. 1, 2000 and entitled "Biomaterials Formed by Nucleophilic Addition Reaction to Conjugated Unsaturated Groups," and pending U.S. patent application Ser. No. 09/586,937 to Hubbell et al., filed Jun. 2, 2000 and entitled "Conjugate Addition Reactions for the Controlled Delivery of Pharmaceutically Active Compounds". The entirety of each of these patent applications is hereby incorporated herein by reference for all purposes.

For example, such a system can be a three-component medium formed by the Michael addition process. This curable system is useful in applications in implants such as an inflatable endovascular graft and is dependent upon mixing the components in a particular sequence for a particular duration to be effective. Such a medium can include:

(1) polyethylene glycol diacrylate (PEGDA), present in a proportion ranging from about 50 to about 55 weight percent; or specifically in a proportion of about 52 weight percent, (2) pentaerthyritol tetra 3(mercaptopropionate) (QT) present in a proportion ranging from about 22 to about 27 weight percent; or specifically in a proportion of about 24 weight percent, and (3) glycylglycine buffer present in a proportion ranging from about 22 to about 27 weight percent; or specifically in a proportion of about 24 weight percent.

Variations of these components and other formulations as described in copending U.S. patent application Ser. Nos. 09/496,231 and 09/586,937, both to Hubbell et al., may be used as appropriate. In addition, PEGDA having a molecular weight ranging from about 350 to about 850 can be useful; and PEGDA having a molecular weight ranging from about 440 to about 560 can be particularly useful.

Radiopaque materials may be added to this 3-component system. Adding radiopacifiers such as barium sulfate, tantalum powder, and/or soluble materials such as iodine compounds to the glycylglycine buffer can be useful.

In the case of the use of the curable three-component PEGDA-QT-glycylglycine formulation described above in filling inflatable grafts of the type described in copending U.S. patent application Ser. No. 10/327,711 to Chobotov et al., a careful preparation and delivery protocol should be followed to ensure proper mixing, delivery, and ultimately clinical efficacy. Each of the three components is typically packaged separately in sterile containers such as syringes until the appropriate time for deploying the endovascular graft. The QT and buffer (typically glycylglycine) are first continuously and thoroughly mixed in a device such as device 10 of the present invention, typically between their respective syringes, for approximately two minutes. PEGDA is then mixed thoroughly with the resulting two-component mixture for approximately three minutes. This resulting three-component mixture is then ready for introduction into the desired inflatable graft body section as it will cure into a gel having the desired properties within the next several minutes. Cure times may be tailored by adjusting the formulations, mixing protocol, and other variables according to the requirements of the clinical setting. Details of suitable delivery protocols for these materials are discussed in copending U.S. patent application Ser. No. 09/917,371 to Chobotov et al.

The various mixing devices 10 described herein are particularly useful for mixing these components as described above due to the controlled nature of the mixing sequence and the thorough mixing of the components that are possible by using device 10.

It can be helpful to add an inert biocompatible material to the inflation material. For example, adding a fluid such as saline to the PEGDA-QT-glycylglycine formulation (typically after it has been mixed but before significant curing takes place) can lower the viscosity of the formulation and result in greater ease when injecting the formulation into the graft body section network of inflatable cuffs and channels without sacrificing the desired physical, chemical, and mechanical properties of the formulation or its clinical efficacy. Saline concentrations as a volume percentage of the final saline/three-component formulation combination may range from zero to as high as sixty percent or more; particularly suitable are saline concentrations ranging from about twenty to about forty percent. For example, a saline volume concentration of about thirty percent can be suitable. Alternatives to saline may include biocompatible liquids, including buffers such as glycylglycine.

This foregoing is but a single class of examples of how a mixing device 10 of the present invention can be used for a very particular application. It is understood that, however, that the present device and methods may be used in a wide variety of other medical as well as non medical applications.

The methods and devices of the present invention may be provided in one or more kits for such use. For example, the kits may include a base coupled with a set of linkages, in operative cooperation with a set of syringes, and instructions for use. Relatedly, the kits may further include any of the other system or device components described in relation to the present invention and any other materials or items relevant to the present invention, including materials to be mixed. The instructions for use can set forth any of the methods as described herein, and kit components can be packaged together in a pouch or a conventional surgical device packaging. Often, certain kit components will be sterilized and maintained within the kit. Optionally, separate pouches, bags, trays, or other packaging can be provided within a larger package, where the smaller packs may be opened individually to separately maintain the components in sterile fashion. A kit may also include a mixing manifold and a plurality of syringes, such as shown in FIGS. 8 and 9, along with instructions for use and an optional timer. The syringes can contain an n-component fill fluid, where n can be any integer. For example, the kit can include materials for a 3-component fill fluid.

Although there is shown and described certain embodiments of the invention, this invention is not limited thereto, but may be variously embodied to practice the scope of the following claims. From the foregoing description, it will be apparent that various changes may be made without departing from the spirit and scope of the invention as defined by the following claims.

What is claimed is:

1. A device for mixing a material, the device comprising:

a base for supporting said device on a surface;

a first container and a second container;

a first linkage coupled to said base at a first fixed pivot point, the first linkage comprising at least two bars coupled together via at least one first linkage pivot joint, the first linkage configured to contact a first plunger of a first syringe to move a material from the first container through a conduit to the second container; and a second linkage coupled to said base at a second fixed pivot point, the second linkage comprising at least two bars coupled together via at least one second linkage pivot joint, the second linkage configured to contact a second plunger of the second container to move the material from the second container through the conduit manifold to the first container.

2. The device of claim 1, wherein the device is configured to mix the material by movement of the material between the first and second containers via the conduit.

3. The device of claim 1, wherein the device is configured to mix a first material contained in the first container with a second material contained in the second container by movement of the first and second materials between the first and second containers via the conduit.

4. The device of claim 1, wherein the first linkage comprises a first linkage rocker bar and a first linkage coupler bar, such that the first linkage rocker bar is pivotally coupled with the base, and a first end of the first linkage coupler bar is in translational cooperation with the base.

5. The device of claim 4, wherein the first linkage comprises a first linkage geometry such that activation of the first linkage is accomplished by a force applied at a handle end of the first linkage rocker bat, the force having a primary vector substantially orthogonal to a resting plane of the base.

6. The device of claim 5, wherein the first linkage geometry ensures that the primary vector is sufficient to maintain the position of the base on a resting surface during operation of the device.

7. The device of claim 1, wherein the second linkage comprises a second linkage rocker bar and a second linkage coupler bar, such that the second linkage rocker bar is pivotally coupled with the base, and a first end of the second linkage coupler bar is in translational cooperation with the base.

8. The device of claim 7, wherein the second linkage comprises a second linkage geometry such tat activation of the second linkage is accomplished by a force applied at a handle end of the second linkage rocker bar, the force having a primary vector substantially orthogonal to a resting plane of the base.

9. The device of claim 8, wherein the second linkage geometry ensures that the primary vector is sufficient to maintain the position of the base on a resting surface during operation of the device.

10. The device of claim 1, wherein the conduit comprises a tube.

11. The device of claim 1, wherein the conduit comprises a manifold.

12. The device of claim 1, wherein at least one of the first and second containers comprises a syringe.

13. A device for mixing a material, the device comprising;

a base for supporting said device on a surface;

a first linkage coupled with said base at a first fixed pivot point, the first linkage configured to move a first material from a first container to a second container chamber via a conduit; and a second linkage coupled with said base at a second fixed pivot point, the second linkage configured to move the material from the second container via the conduit to the first container;

wherein the first linkage comprises a first linkage rocker bar pivotally coupled with a first linkage coupler bar via a first linkage rocker-coupler joint, the first linkage coupler bar configured to transmit a force to the first container, arid the second linkage comprises a second linkage rocker bar pivotally coupled with a second linkage coupler bar via a second linkage rocker-coupler joint, the second linkage coupler bar configured to transmit a force to the second container.

14. The device of claim 13, wherein the device is configured to mix the first material contained in the first container with a second material contained in the second container, and wherein the movement of the first and second materials between the first and second containers contributes to the mixing of the first and second materials.

15. The device of claim 14, wherein the first container comprises a first syringe and the second container comprises a second syringe, and wherein the first linkage is configured to drive a first plunger of the first syringe end the second linkage is configured to drive a second plunger of the second syringe.

16. The device of claim 15, wherein the first linkage rocker bar is pivotally coupled with the base, and a first end of the first linkage coupler bar is in translational cooperation with the base.

17. The device of claim 15, wherein the second linkage rocker bar is pivotally coupled with the base, and a first end of the second linkage coupler bar is in translational cooperation with the base.

18. The device of claim 15, wherein the first linkage comprises a first linkage geometry such that activation of the first linkage is accomplished by a force applied at a handle end of the first linkage rocker bar, the force having a primary vector substantially orthogonal to a resting plane of the base.

19. The device of claim 18, wherein the first linkage geometry ensures that the primary vector is sufficient to maintain the position of the base on a resting surface during operation of the device.

20. The device of claim 15, wherein the second linkage comprises a second linkage geometry such that activation of the second linkage is accomplished by a force applied at a handle end of the second linkage rocker bar, the force having a primary vector substantially orthogonal to a resting plane of the base.

21. The device of claim 20, wherein the second linkage geometry ensures that the primary vector is sufficient to maintain the position of the base on a resting surface during operation of the device.

22. A device for mixing a material, the device comprising:

a base for supporting said device on a surface;

a first linkage coupled to said base at a first fixed pivot point, the first linkage comprising a first linkage rocker bar coupled with a first linkage coupler bar via at least one first linkage pivot joint, the first linkage coupler bar configured to contact a first plunger of a first syringe to move a material from a first syringe through a conduit to a second syringe; and a second linkage coupled to said base at a second fixed pivot point, the second linkage comprising a second linkage rocker bar at least two bars coupled a second linkage coupler bar together via at least one second linkage pivot joint, the second linkage coupler bar configured to contact a second plunger of the second syringe to move the material from the second syringe through the conduit to the first syringe; and a plurality of feet on a resting surface of the base, each foot comprising a retractable point and a contact patch, the retractable point and the contact patch adapted to contact a surface and inhibit movement of the device on the surface;

wherein the movement of the material between the first and second syringes contributes to the mixing of the material.

23. A system for mixing a first material with a second material, the system comprising:

a) a first linkage having a first linkage rocker bar coupled with a first linkage coupler bar via at least two bars and at least one first linkage pivot joint;

b) a second linkage having a second linkage rocker bar coupled with a second linkage coupler bar via at least one second linkage pivot joint;

c) a first syringe containing a first material;

d) a second syringe containing a second material; and e) a base for supporting said device on a surface, coupled with said first linkage said first linkage coupled to a first fixed pivot point and said second linkage, said second linkage coupled to a second fixed pivot point;

wherein the first linkage is configured to contact a first plunger of the first syringe to move the first material through a conduit to a second syringe; the second linkage is configured to contact a second plunger of the second syringe to move the first material and the second material through the conduit to the first syringe; and the movement of the first and second materials between the first and second syringes contributes to the mixing of the materials.

24. A kit comprising:

a mixer comprising:

a base for supporting said device on a surface;

a first linkage coupled to said base at a first fixed pivot point, the first linkage comprising at least two bars coupled together via at least one first linkage pivot joint, the first linkage configured to contact a first activator of a first container to move a material from the first container through a conduit to a second container;

a second linkage coupled to said base at a second fixed pivot point, the second linkage comprising at least two bars coupled together via at least one second linkage pivot joint, the second linkage configured to contact a second activator of the second container to move the material from the second container through the conduit to the first container; and instructions to use the mixer for mixing at least one material.

* * * * *